US005484233A

United States Patent [19]

Kunito

[11] Patent Number: 5,484,233

[45] Date of Patent: Jan. 16, 1996

[54] EXCAVATOR AND A METHOD OF FORMING A MODIFIED GROUND IN AN EARTHEN FOUNDATION WITH THE USE OF THE SAME

[75] Inventor: Mitsuhiro Kunito, Osaka, Japan

[73] Assignee: Kabushiki Kaisha Ask Ken Kyusho, Osaka, Japan

[21] Appl. No.: 329,835

[22] Filed: Oct. 27, 1994

[30] Foreign Application Priority Data

Mar. 1, 1994 [JP] Japan ..... 6-031524

[51] Int. Cl.[6] ..... E02D 3/12

[52] U.S. Cl. ..... 405/240; 405/248; 405/269

[58] Field of Search ..... 405/233, 236, 405/237, 240, 241, 242, 248, 269; 175/267

[56] References Cited

U.S. PATENT DOCUMENTS

| | | | |
|---|---|---|---|
| 4,433,943 | 2/1984 | Chen | 405/241 |
| 4,624,606 | 11/1986 | Nakanishi et al. | 405/269 |
| 4,786,212 | 11/1988 | Bauer et al. | 405/269 |
| 4,906,142 | 3/1990 | Taki et al. | 405/241 X |
| 5,256,004 | 10/1993 | Gemmi et al. | 405/237 |
| 5,399,056 | 3/1995 | Shibazaki et al. | 405/233 |
| 5,411,353 | 5/1995 | Taki | 405/241 |

FOREIGN PATENT DOCUMENTS

| | | | |
|---|---|---|---|
| 119024 | 9/1981 | Japan | 405/240 |
| 33641 | 2/1983 | Japan | 405/240 |
| 154214 | 9/1984 | Japan | 405/240 |
| 62333 | 4/1985 | Japan | 405/241 |
| 125017 | 5/1990 | Japan | 405/241 |
| 212506 | 9/1991 | Japan | 405/241 |

*Primary Examiner*—John A. Ricci
*Attorney, Agent, or Firm*—Armstrong, Westerman, Hattori, McLeland & Naughton

[57] ABSTRACT

A modified ground, which is utilized for an underground water cut-off wall, landslide protection wall, a foundation pile or the like, is formed in an earthen foundation with the use of an excavator having at least one rotary shaft. The rotary shaft includes a bit provided on a bottom end thereof, and at least one pair of upper and lower nozzles for jetting a consolidating fluid. The upper nozzle is capable of jetting the consolidating fluid in a downwardly diagonal direction so as to generate a joined jet of the consolidating fluid in a downwardly diagonal direction by collision of the consolidating fluid jetted from the upper and lower nozzles. In the present method, the rotary shaft is inserted into the earthen foundation to form a hole therein, and then withdrawn away from the hole while rotating the rotary shaft and jetting the consolidating fluid from the upper and lower nozzles against soil surrounding the hole for enlarging the diameter of the hole in such a manner as to perform an in-situ mixing and stirring of the consolidating fluid and soil. After the resulting mixture is hardened, the modified ground having a larger diameter than the hole is formed in the earthen foundation.

16 Claims, 22 Drawing Sheets

2
50
17
14
13

2
50
17
14
13

2
50
17
16
13
15

2
16
13
51
15

51

2
50
17
14
13
60

2
50
17
14
13
60

2
50
17
51
60

2
16
51
15
60

51E 2E
17E
70E
71E
15E
16E
13E
51E 50E
53E
51E 2E
50E
2E
50E
17E
70E
71E
14E
14E
13E 50E
53E
S
50E

EXCAVATOR AND A METHOD OF FORMING A MODIFIED GROUND IN AN EARTHEN FOUNDATION WITH THE USE OF THE SAME

BACKGROUND OF THE INVENTION

1. Field of the Invention

The present invention relates to an excavator and a method of forming a modified ground in an earthen foundation with the use of the excavator, and more particularly a method of constructing an underground water cut-off wall, landslide protection wall, a foundation pile or the like, in the earthen foundation with the use of the excavator.

2. Disclosure of the Prior Art

In the prior art, Japanese Patent Early Publication [KOKAI]No. 05-346020 teaches that a modified ground is formed in an earthen foundation by applying a mechanical stirring and an injection of a consolidating fluid. As shown in FIG. 33, this method utilizes an excavator having a rotary shaft 2H. The rotary shaft 2H has a pair of stirring wings 60H which are spaced away from each other axially of the rotary shaft 2H. Each of the stirring wings 60H is provided with a nozzle 15H for jetting the consolidating fluid. The stirring wings 60H are also disposed on the rotary shaft 2H such that the consolidating fluid jetted from one of the nozzles 15H collides with that jetted from the other nozzle.

The modified ground of this prior art is composed of a core pile P1 having a diameter D1 and a ring pile P2 having an outer diameter D2. The core pile P1 is formed by stirring and mixing an excavated soil with the consolidating fluid jetted from a bottom nozzle 14H of the rotary shaft with the use of the stirring wings 60H. At the same time, the ring pile P2 is formed by jetting the consolidating fluid from the nozzles 15H against soil surrounding the core pile P1. Since the diameter D2 of the ring pile P2 is varied by controlling a collision position of the consolidating fluid jetted from the nozzles 15H, it is possible to form the modified ground having a desired diameter.

However, a mixing state of the excavated soil with the consolidating fluid in the core pile P1 would be different from the mixture state in the ring pile P2 because the soil in the core pile p1 is mixed with the consolidating fluid mainly by the stirring wings 60H, and on the other hand the soil in the ring pile P2 is excavated mainly by the consolidating fluid jetted from the nozzles 15H without utilizing the stirring wings 60H. As a result, it would be difficult to obtain an uniform structure of the modified ground as a whole.

In addition, when a joined jet of the consolidating fluid, which is generated by collision of the consolidating fluid jetted from the nozzles 15H, advances in a horizontal or upwardly diagonal direction, there is a probability of causing upheavals on the ground or blowing the soil to the outside of the modified ground by the jet of the consolidating fluid. In particular, when thus blown soil hits the worker, it would give a serious injury to the worker.

SUMMARY OF THE INVENTION

For improving the above problems, the present invention is directed to an improved excavator, and a method of forming a modified ground pillar or wall in an earthen foundation with the use of the excavator. The excavator has at least one rotary shaft which includes means for excavating the earthen foundation and at least one pair of upper and lower nozzles for jetting a consolidating fluid. The upper nozzle is capable of jetting the consolidating fluid in a downwardly diagonal direction so as to generate a joined jet of the consolidating fluid in a downwardly diagonal direction by collision of the consolidating fluid jetted from the upper and lower nozzles.

The modified ground pillar can be formed with the use of the excavator according to the following method. The rotary shaft is inserted at a predetermined depth in the earthen foundation to form therein a hole without jetting the consolidating fluid from the upper and lower nozzles. Subsequently, the rotary shaft is withdrawn away from the bottom of the hole while rotating the rotary shaft and jetting the consolidating fluid from those nozzles against soil surrounding the hole to break the same for enlarging the diameter of the hole in such a manner as to perform an in-situ mixing and stirring of the consolidating fluid and soil. As a result, the modified ground pillar having a larger diameter than the hole is formed in the earthen foundation. Since the joined jet of the consolidating fluid is always advanced in the diagonally downward direction, it is possible to continue the withdrawing step precisely and safely even at the periphery of an entrance of the hole without causing upheavals of the earthen foundation or blowing the soil to the outside of the hole by the joined jet.

Therefore, it is a primary object of the present invention is to provide an improved excavator, and a method of forming a modified ground safely and precisely with the use of the excavator.

In a preferred embodiment of the present invention, the consolidating fluid can be jetted from the lower nozzle in a substantially horizontal direction, or upwardly diagonal direction. However, in the later case, an injection pressure of the consolidating fluid jetted from the upper nozzle in the downwardly diagonal direction must be determined so as to be larger than that jetted from the lower nozzle in order to advance the joined jet in the downwardly diagonal direction.

In a further preferred embodiment of the present invention, two kinds of consolidating fluids are jetted separately from the upper and lower nozzles. A consolidating reaction is caused by collision between the consolidating fluids from the upper and lower nozzles. Therefore, it is possible to reduce the time necessary for hardening a mixture of the excavated soil and the consolidating fluid. As a result, the modified ground pillar can be efficiently constructed.

In a still further preferred embodiment of the present invention, the rotary shaft also comprises an expandable stirrer. The expandable stirrer is capable of selectively taking an expanded form and a reduced form to vary an outside diameter of the expandable stirrer about the axis of the rotary shaft. In the present method, the expandable stirrer is kept in the reduced form during the inserting step, and in the expanded form during the withdrawing step to facilitate the stirring and mixing of the excavated soil and the consolidating fluid.

It is also preferred that an excavator having a plurality of rotary shafts is utilized for efficiently constructing the modified ground wall in the earthen foundation. Each of the rotary shafts is the substantially same as the above explained rotary shaft. In this case, the withdrawing step of the present invention can be performed so as to cause collision of the consolidating fluid jetted from each of the rotary shafts with that jetted from an adjacent rotary shaft in order to obtain an active stirring and mixing range. On the other hand, it is also possible perform the withdrawing step without causing the collision of the consolidating fluid between the adjacent rotary shafts, if necessary.

Other features, objects and advantages of the present invention will become more apparent from the following description and the attached drawings about the preferred embodiments.

Figure 12:
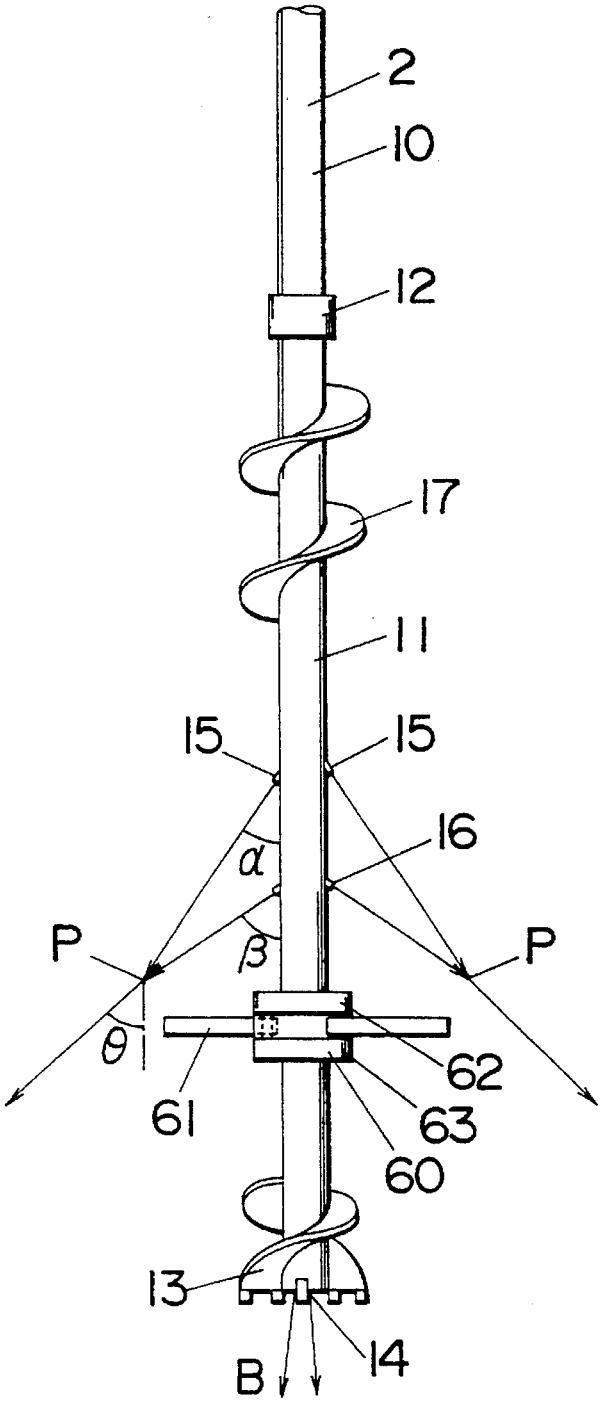
FIG. 12 is a front view of an auger shaft having a folding stirrer.
Figure 14:
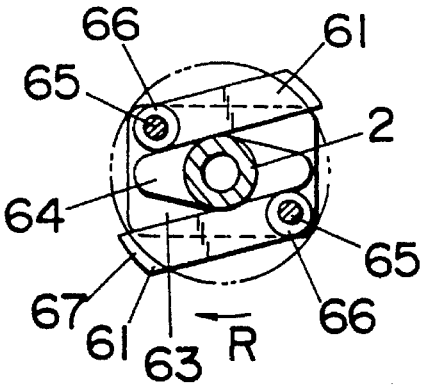
Figure 15:
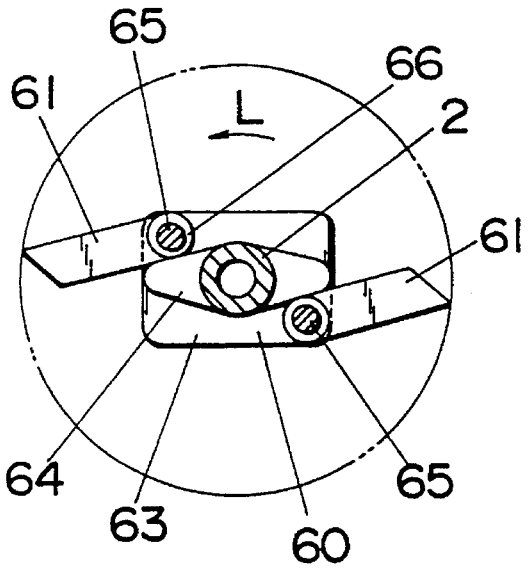
Figure 16:
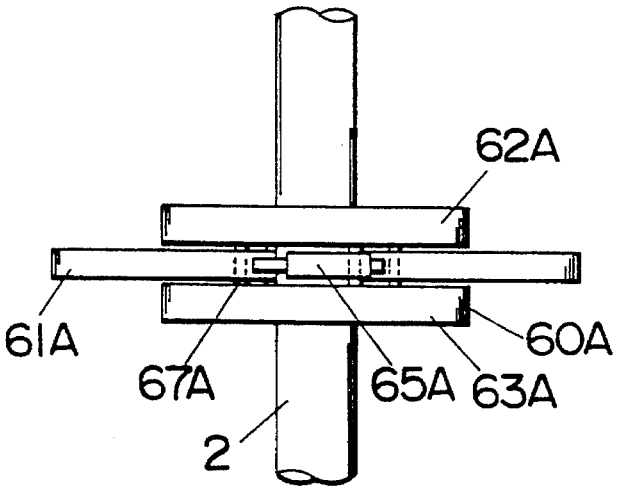
Figure 17:
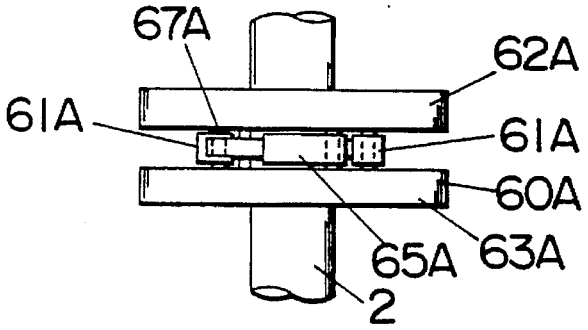
Figure 18:
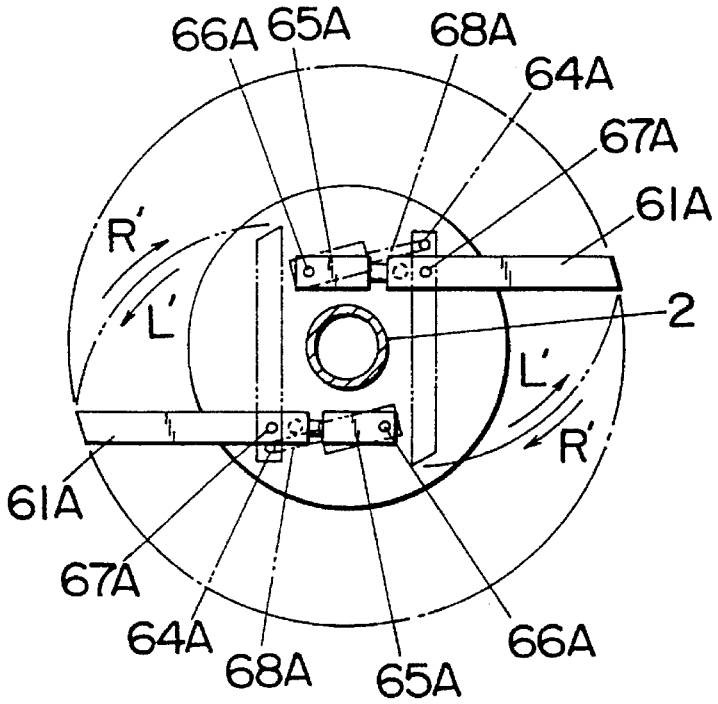
Figure 19:
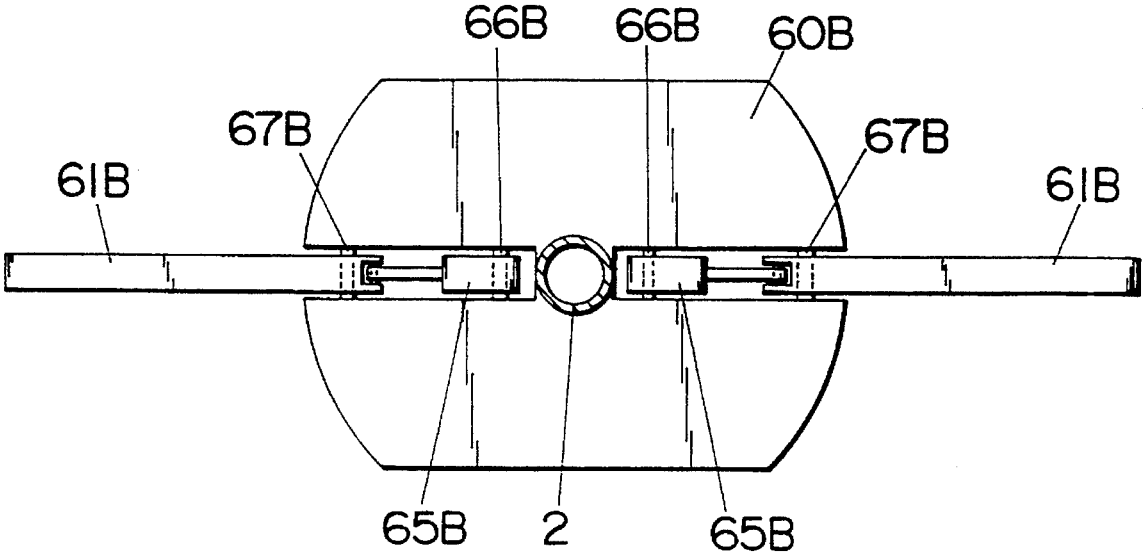
Figure 20:
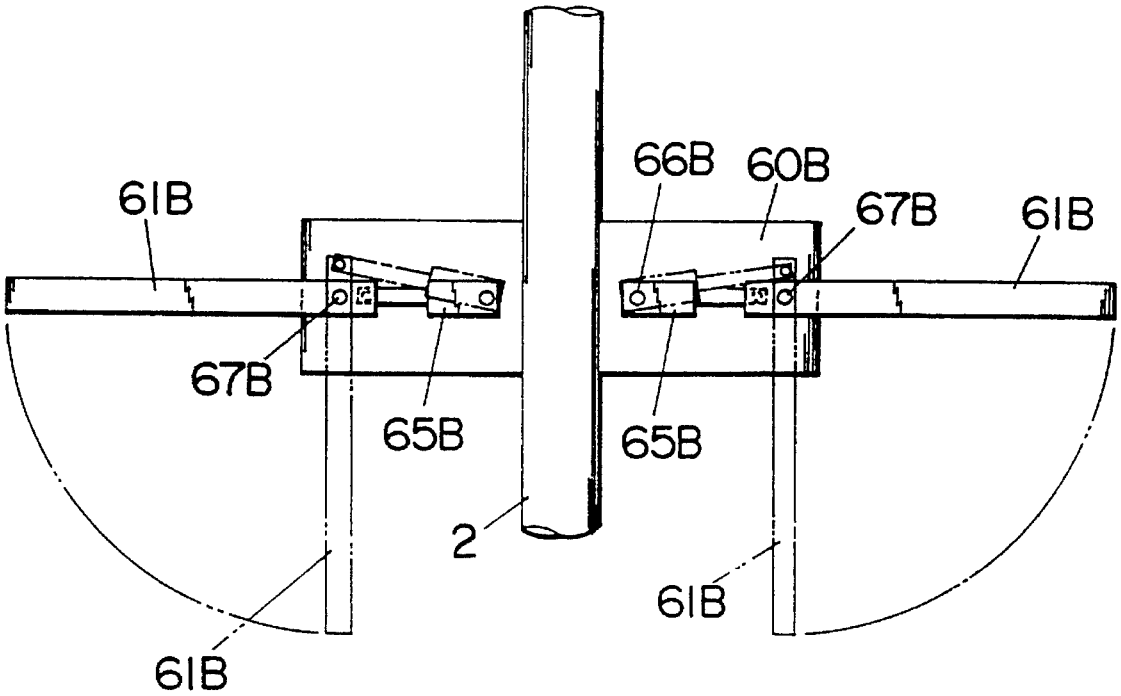
Figure 21:
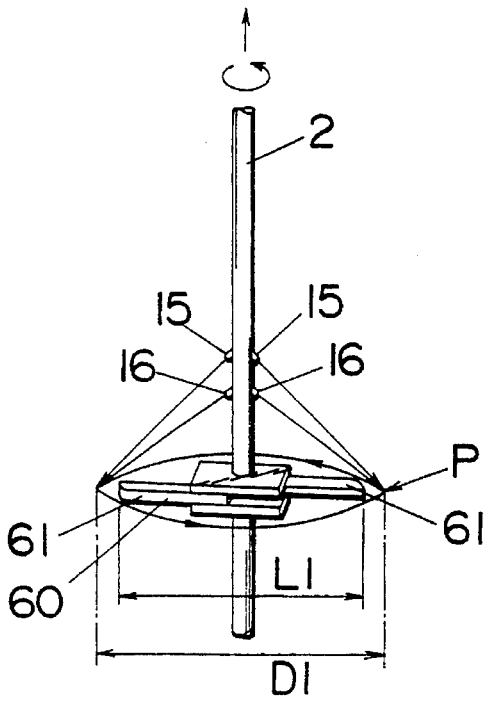
Figure 22:
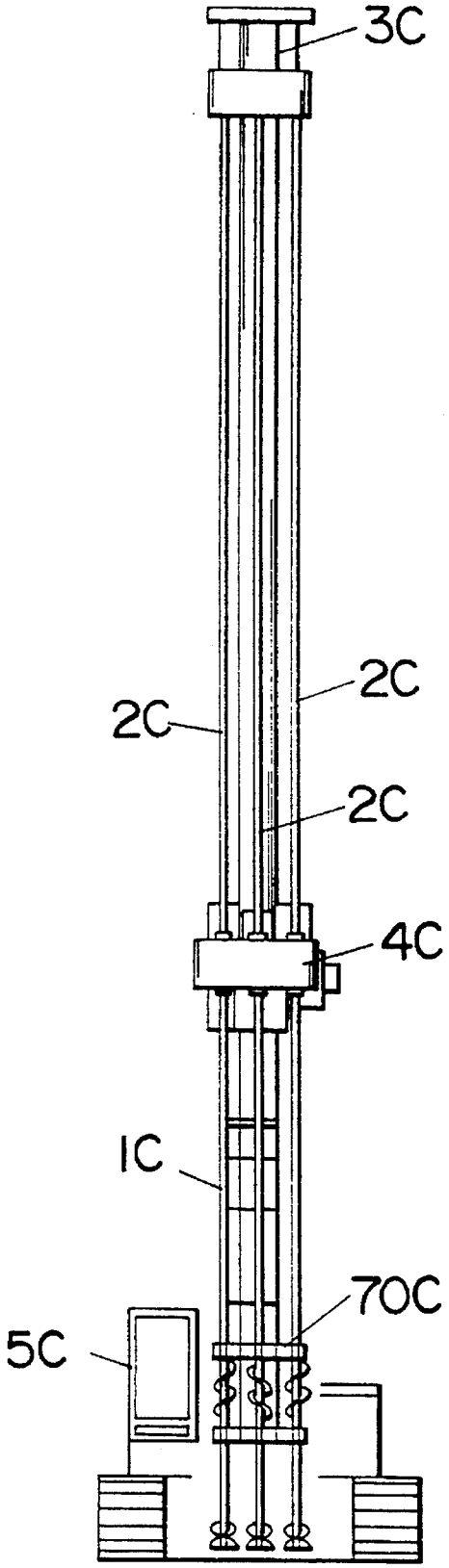
Figure 23:
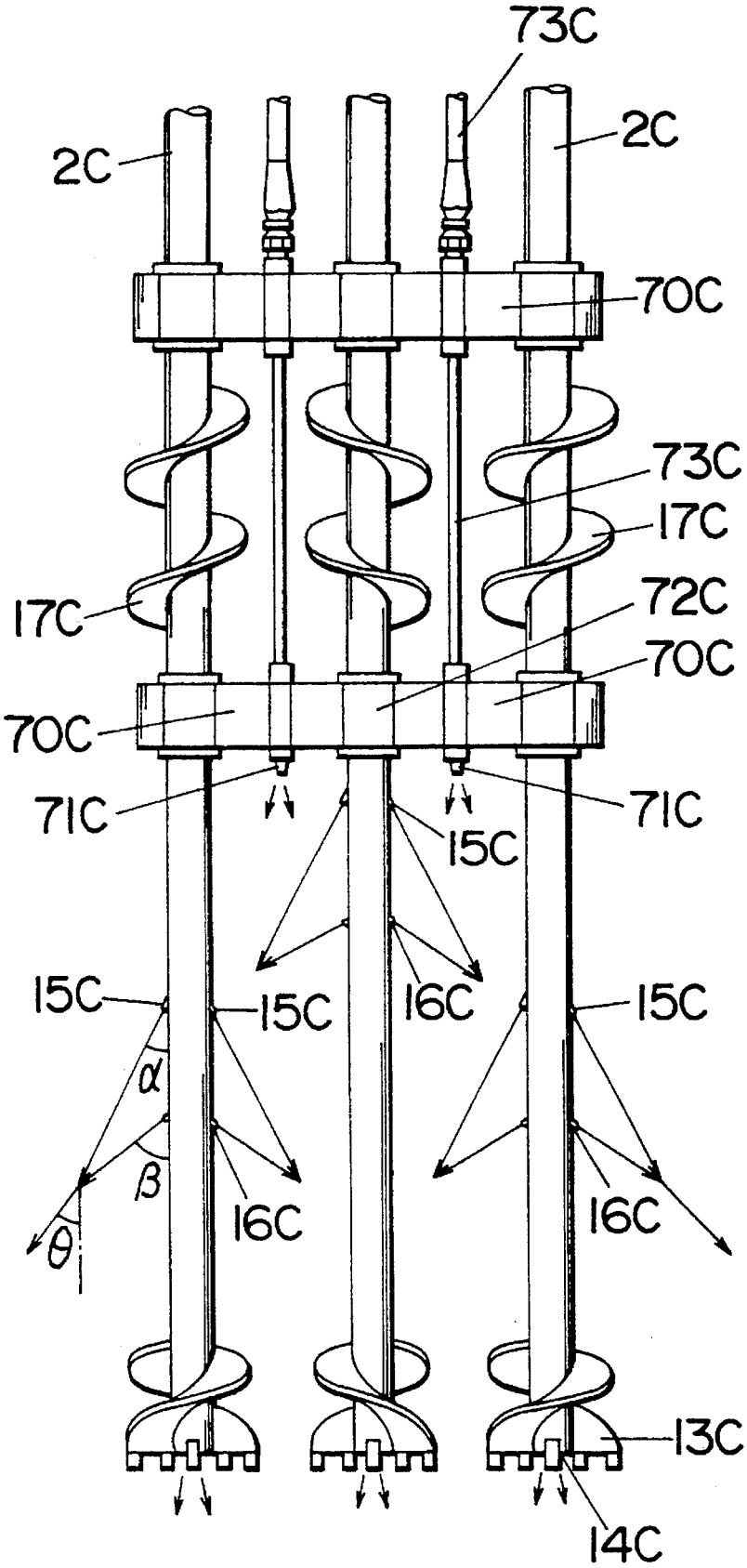
Figure 24:
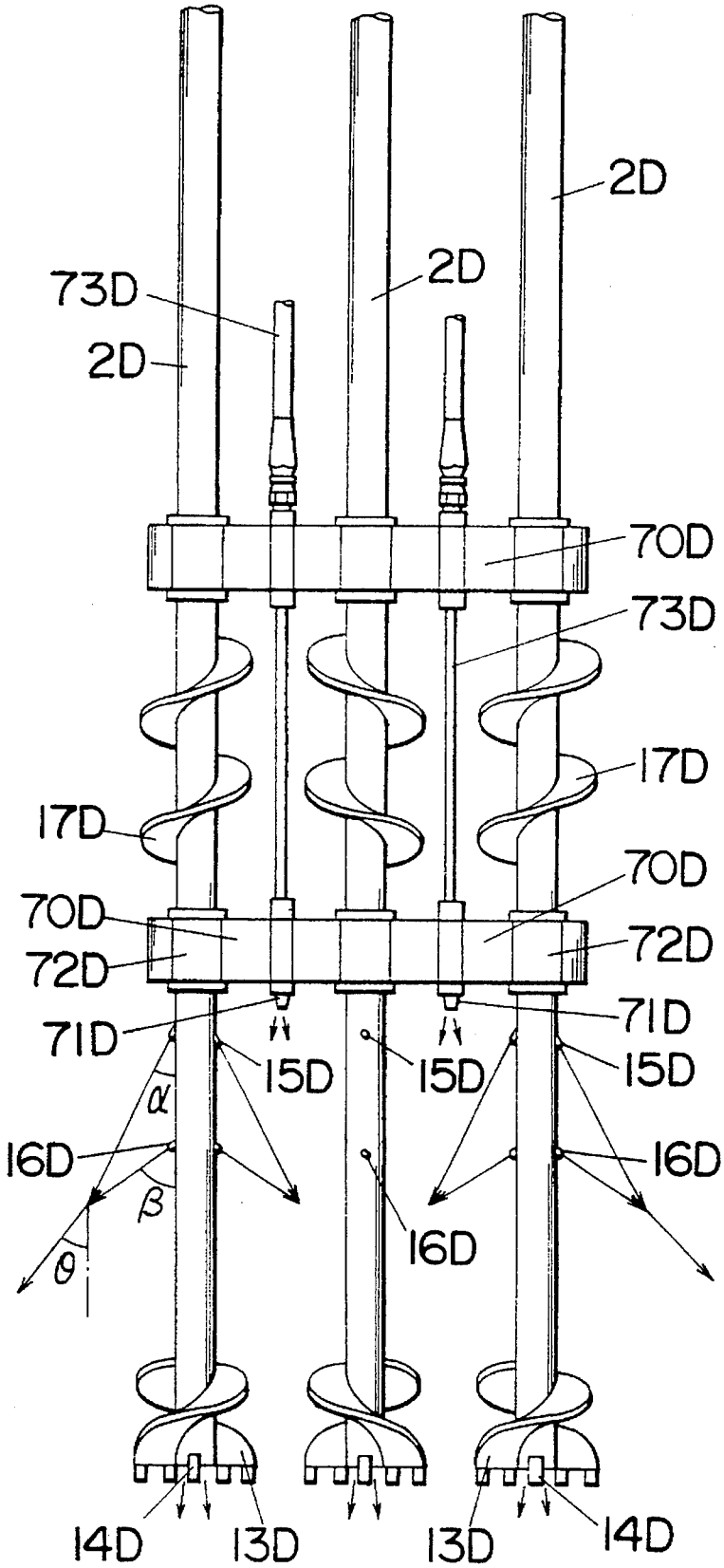
Figure 25:
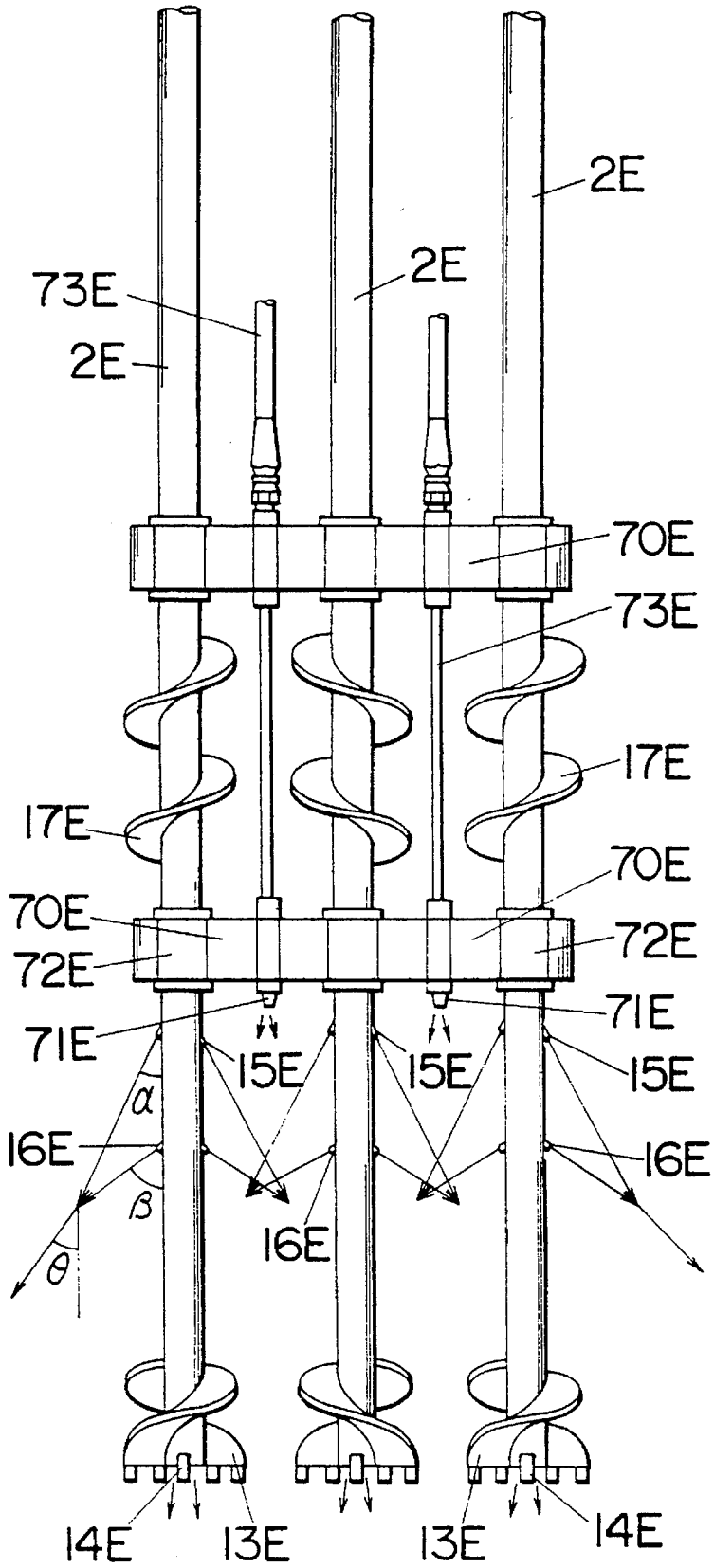
Figure 27:
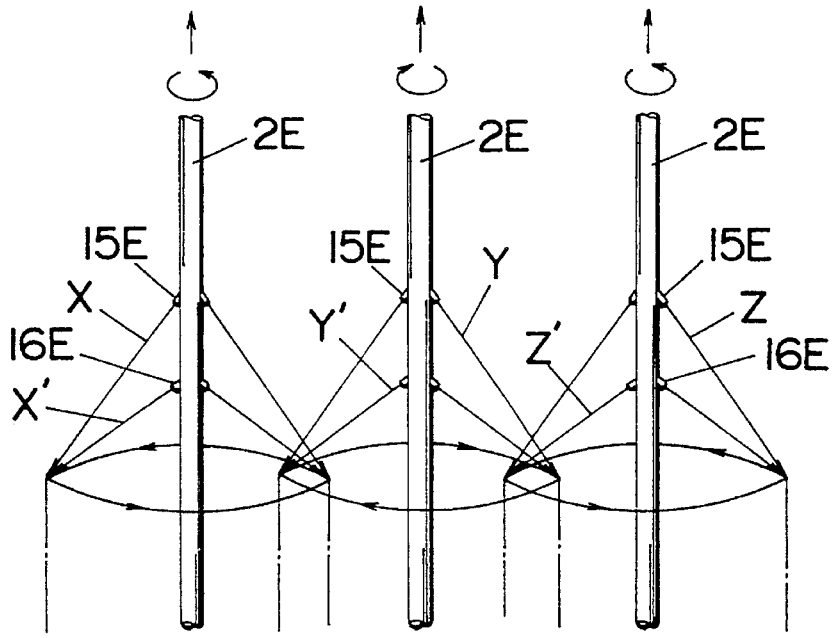
Figure 28:
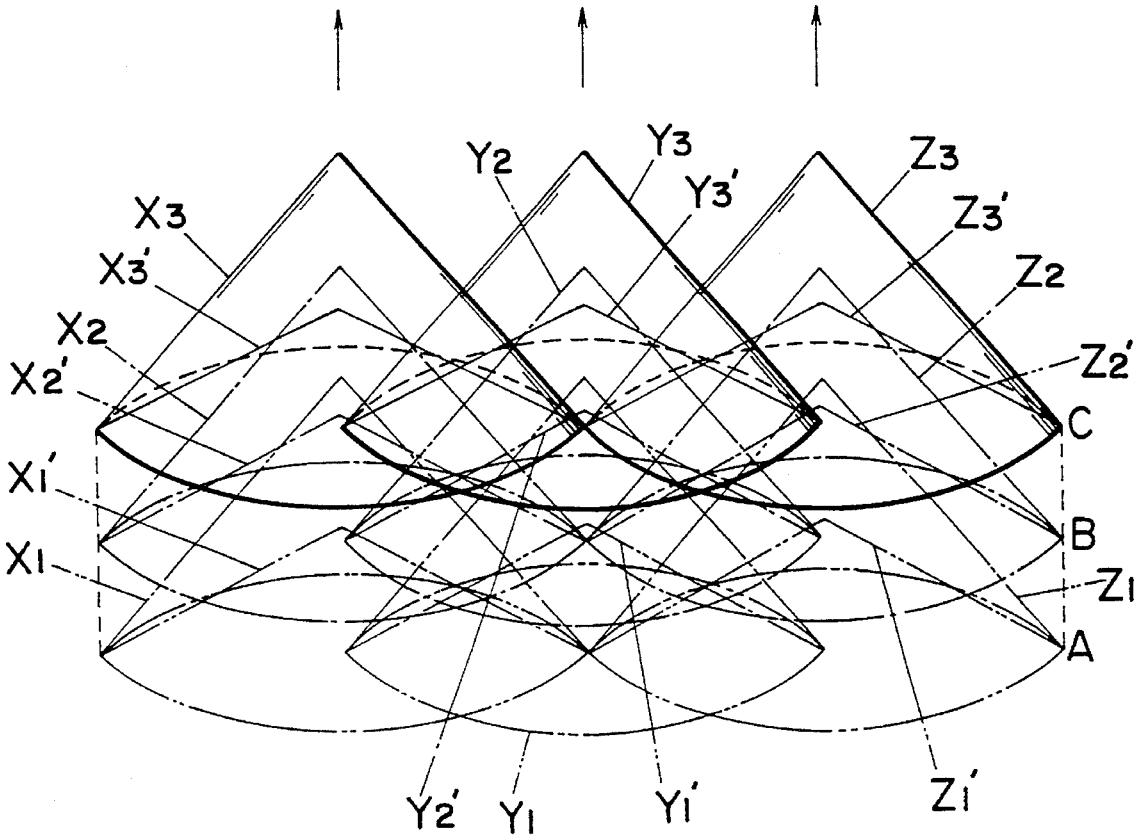
Figure 29:
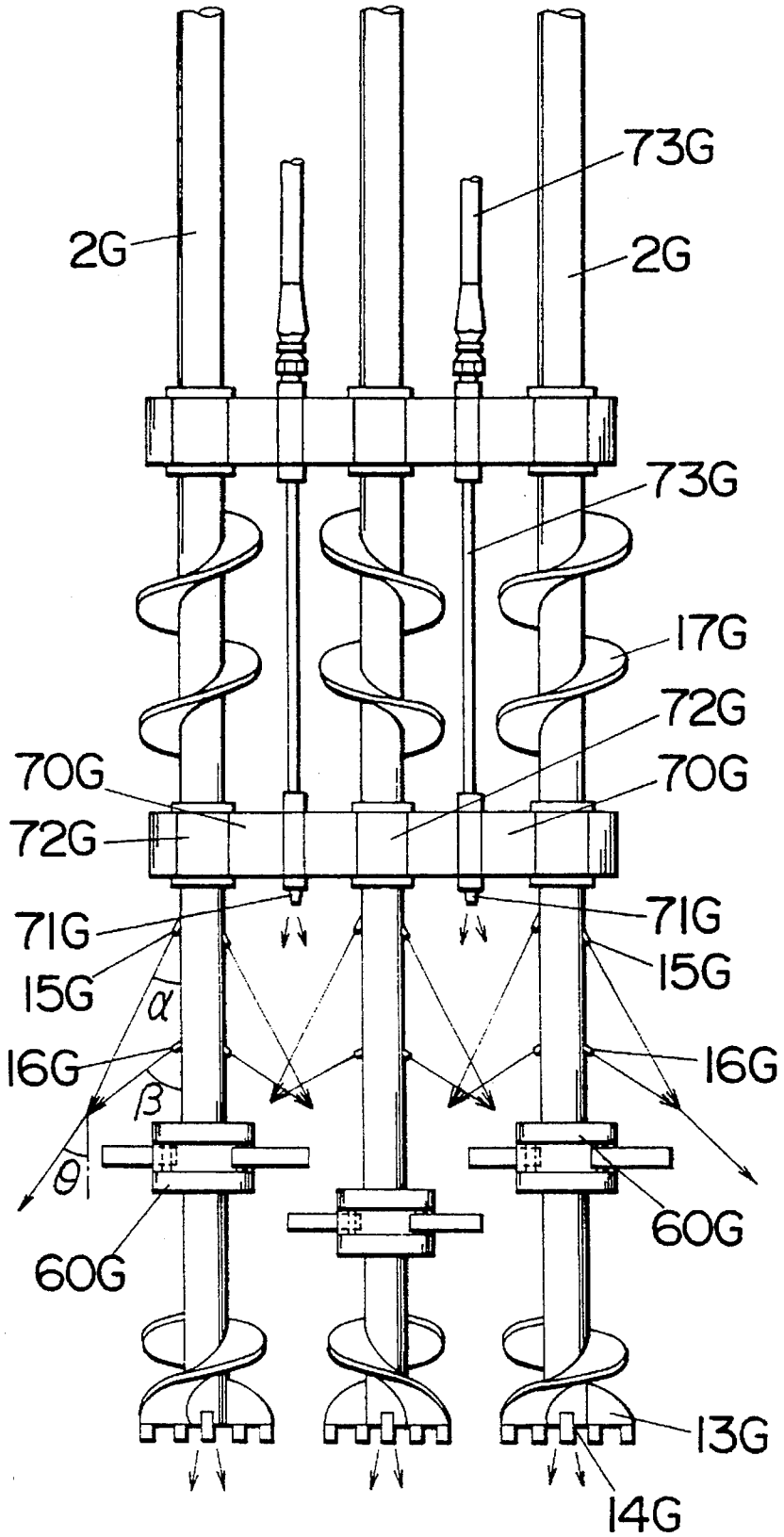
Figure 31:
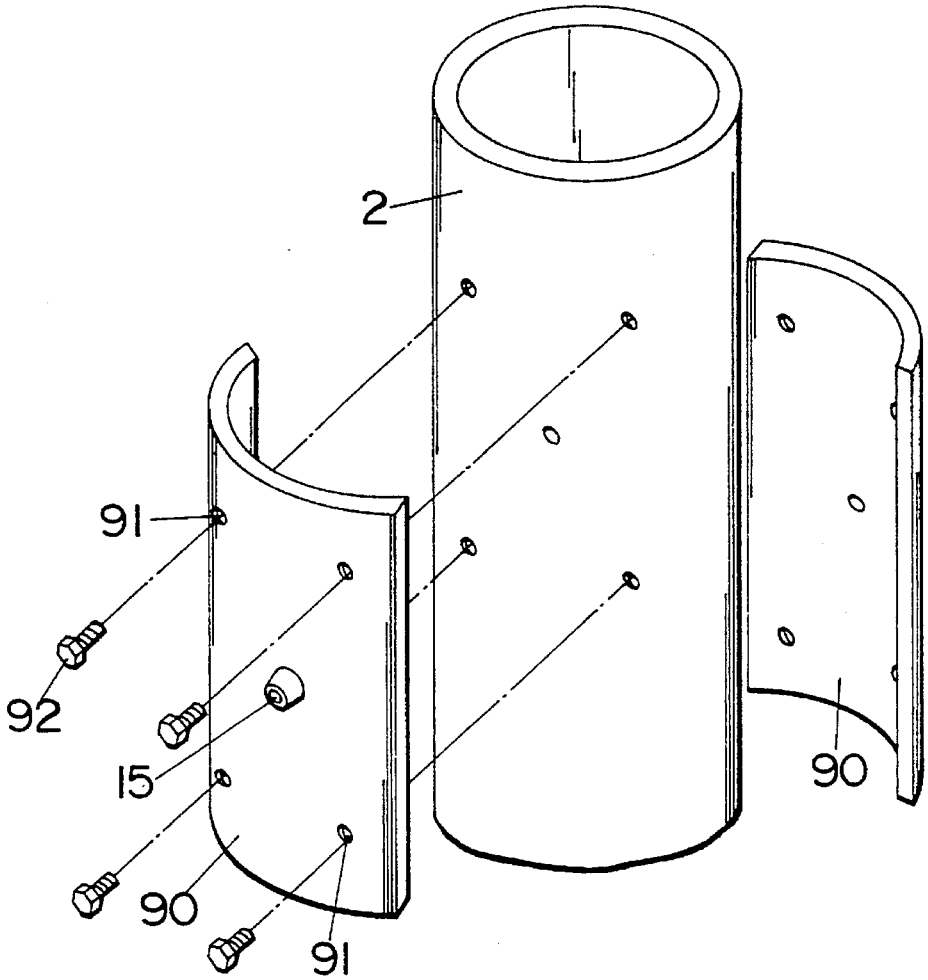
Figure 32:
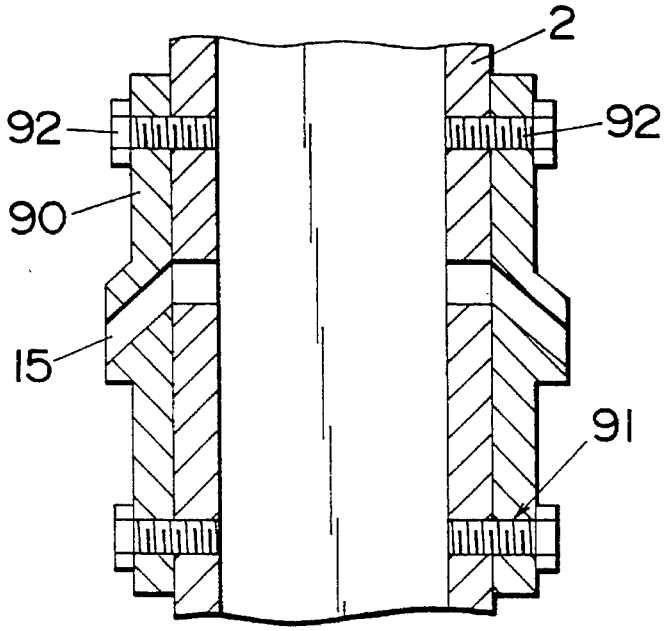
Figure 33:
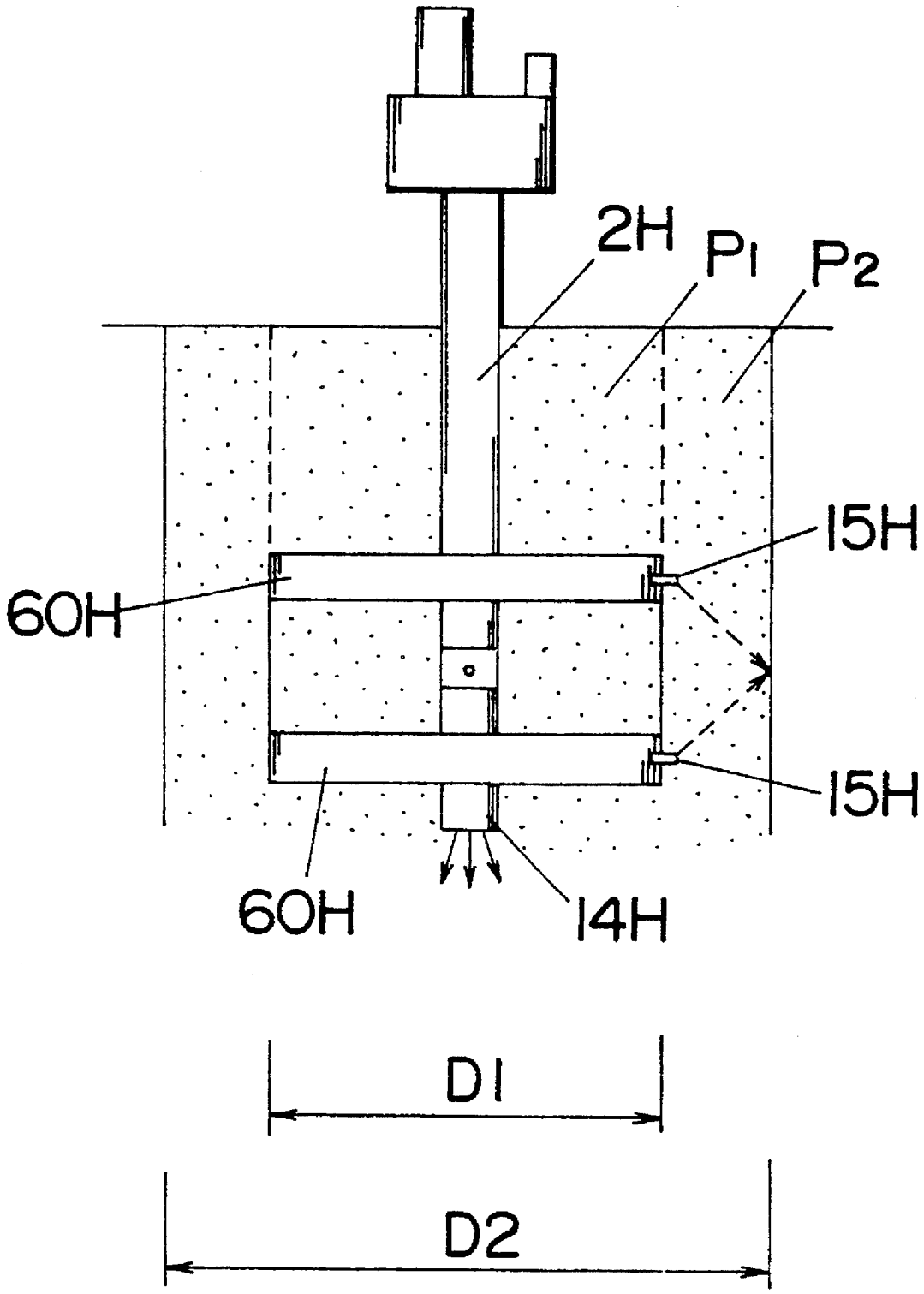
Fig.33 (PRIOR ART)

13A to 13D show a process of forming a modified ground pillar in an earthen foundation with the use of the auger shaft of FIG. 12;

FIG. 14 is a transversely cross-sectional view of the folding stirrer in a reduced form thereof;

FIG. 15 is a transversely cross-sectional view of the folding stirrer in an expanded form thereof;

FIG. 16 is a front view of another folding stirrer in an expanded form thereof;

FIG. 17 is a front view of the folding stirrer of FIG. 16 in a reduced form thereof;

FIG. 18 explains how to expand or reduce the folding stirrer of FIG. 16;

FIG. 19 is a top view of still another folding stirrer in an expanded form thereof;

FIG. 20 explains how to expand or reduce the folding stirrer of FIG. 19;

FIG. 21 is a perspective view showing a stirring and mixing range obtained when the auger shaft of FIG. 12 is rotated while jetting the consolidating fluid;

FIG. 22 is a front view of an excavator having a plurality of auger shafts used in a second embodiment of the present invention;

FIG. 23 is a front view of auger shafts of the present invention;

FIG. 24 is a front view of another auger shafts of the present invention;

FIG. 25 is a front view of still another auger shafts of the present invention;

FIGS. 26A to 26E show a process of forming a modified ground wall in an earthen foundation with the use of the auger shafts of FIG. 25;

FIG. 27 is a perspective view showing stirring and mixing ranges obtained when the auger shafts of FIG. 25 are rotated while jetting a consolidating fluid therefrom;

FIG. 28 is a diagram illustrating stirring and mixing ranges obtained when the auger shafts of FIG. 25 are withdrawn while rotating the auger shafts and jetting the consolidating fluid;

FIG. 29 is a front view of auger shafts having folding stirrers of the present invention;

FIGS. 30A to 30D show a process of forming a modified ground wall in an earthen foundation with the use of the auger shafts of FIG. 29;

FIG. 31 is an exploded perspective view of a nozzle plate and an auger shaft;

FIG. 32 is a cross-sectional view of the auger shaft of FIG. 31 to which the nozzle plate is attached; and FIG. 33 is a front view of a rotary shaft of the prior art.

DESCRIPTION OF THE PREFERRED EMBODIMENTS

<First Embodiment>

Figure 1:
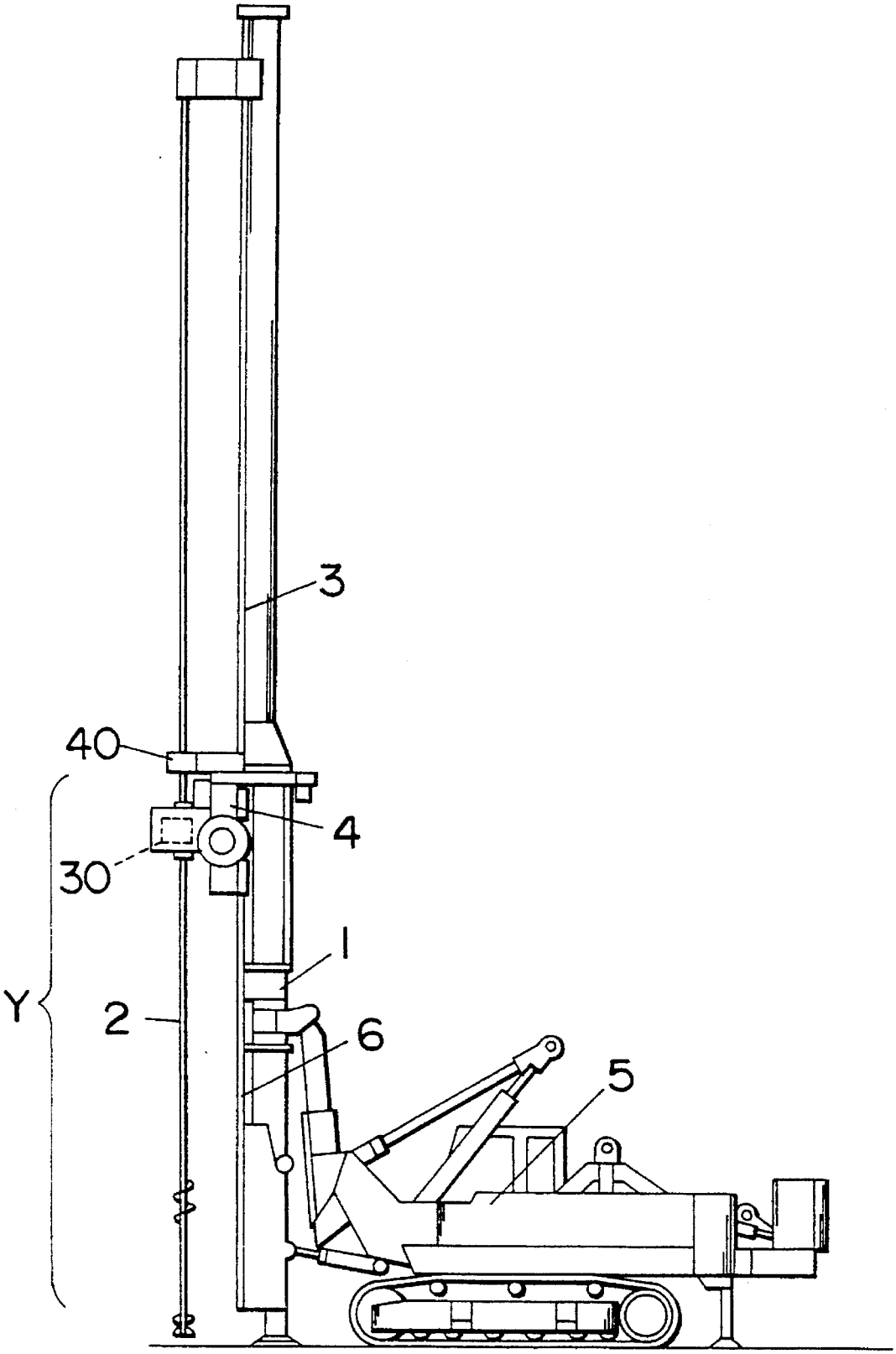
FIG. 1 is an overall side view of an excavator used in a first embodiment of the present invention.

FIG. 1 shows an excavator 1 used in this embodiment, which is fixed on an earthen foundation. The excavator 1 comprises an auger shaft 2, a tower 3 vertically stood on the earthen foundation, a movable housing 4 for incorporating a driving device of the auger shaft 2 and a main chucking device 30 for rotatably chucking the auger shaft 2, and an operation unit 5 of the excavator 1. The movable housing 4 is moved upwardly and downwardly along a guide rail 6 of the tower 3 within a vertical travel shown by the range "Y" of FIG. 1 by the use of a wire or chain. The excavator 1 further includes an auxiliary chucking device 40 of the auger shaft 2 which is disposed in the vicinity of a top end position of the vertical travel "Y".

Figure 2:
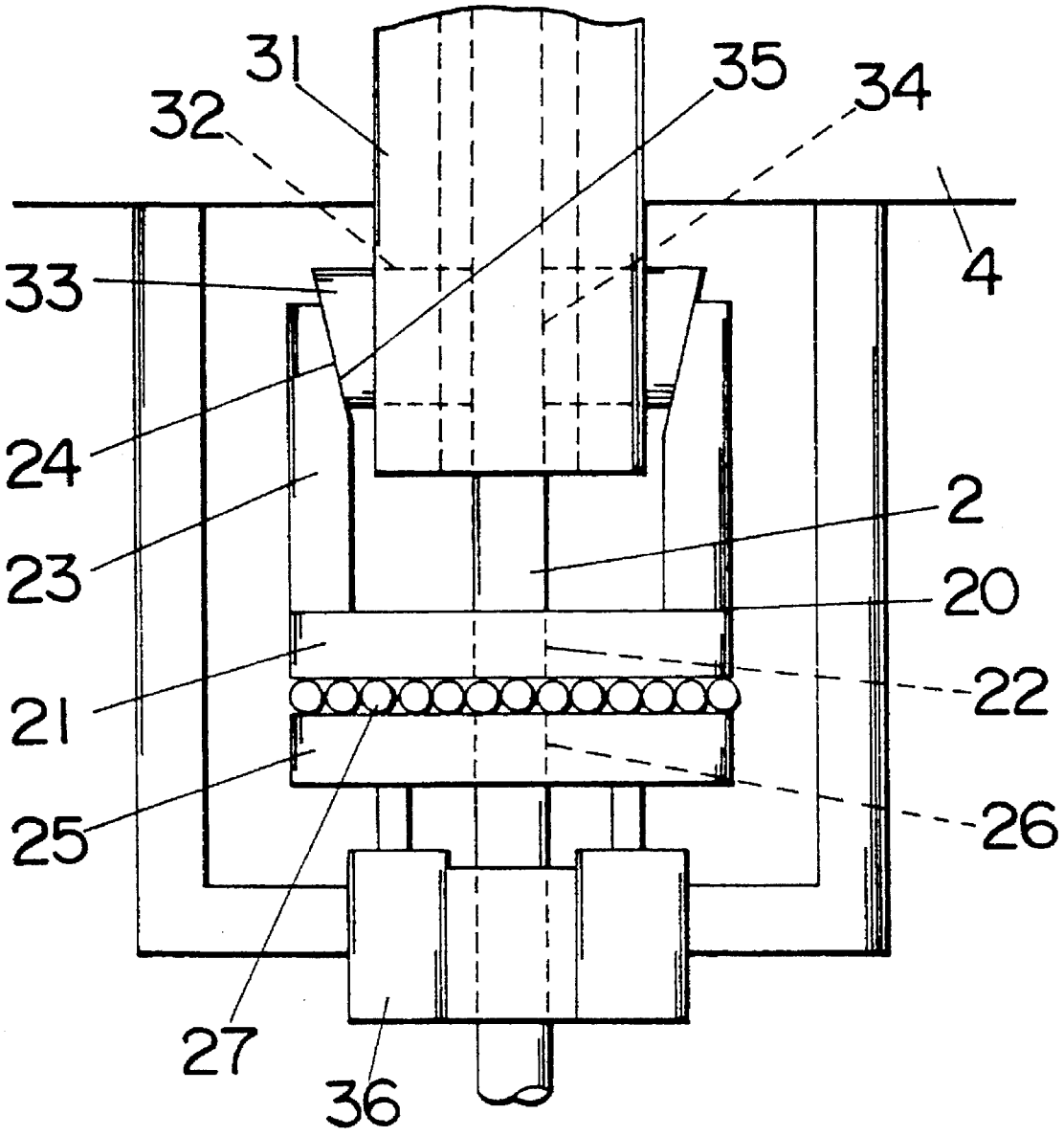
FIG. 2 is a plan view of a main chucking device of an auger shaft of the excavator.
Figure 3:
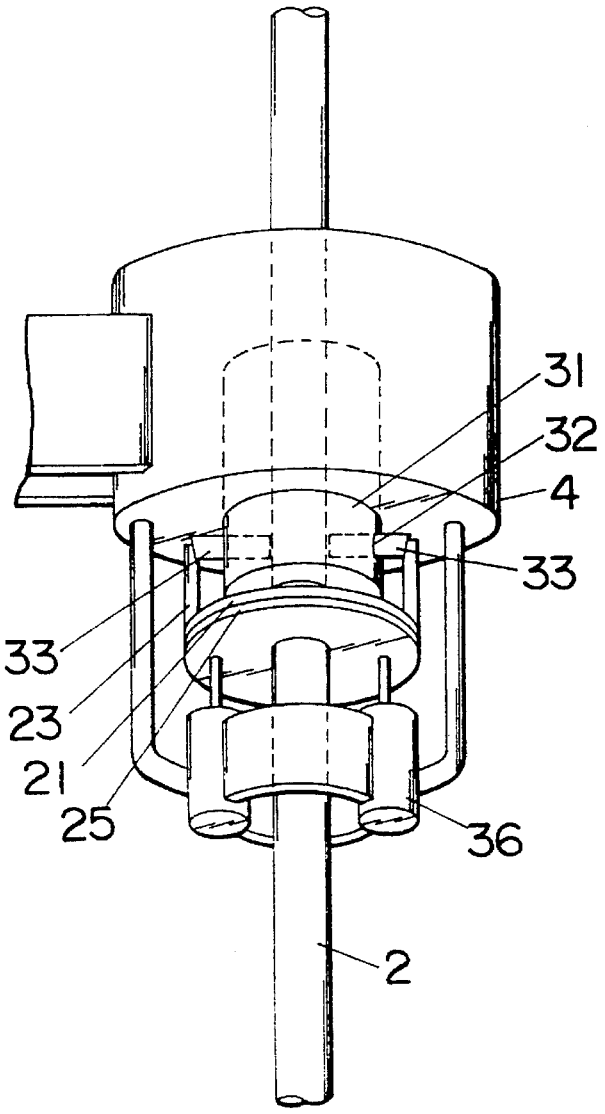
FIG. 3 is a perspective view of the main chucking device.

As shown in FIGS. 2 and 3, the auger shaft 2 passes through a rotary cylinder 31 and slidably contacts with the inner surface of the rotary cylinder 31. The rotary cylinder 31 is rotated by the driving device, and is provided with a pair of horizontal through-holes 32 extending in a diametral direction thereof. Chucking arms 33 are respectively put in the horizontal through-holes 32 slidably in the diametral direction of the rotary cylinder 31. The auger shaft 2 can be chucked between vertical ends 34 of the chucking arms 33. Inclined ends 35 of the chucking arms 33 are respectively projected from the horizontal through-holes 32 outwardly.

A coupling member 20 is formed with a disc 21 having a center through-hole 22 for the auger shaft 2 and a pair of vertical arms 23 extending on the disc 21. Tapered ends 24 of the vertical arms 23 slidably contact with the inclined ends 35 of the chucking arms 33, respectively. A disc table 25 having a center through-hole 26 for the auger shaft 2 is moved upwardly or downwardly by a pair of hydraulic lifter 36 disposed at the periphery of the auger shaft 2. A ball bearing 27 is arranged between the disc 21 and the disc table 25 such that the coupling member 20 can be rotated about the auger shaft 2 on the disc table 25. Therefore, as the disc table 25 is moved upwardly or downwardly by the hydraulic lifter 36, the coupling member 20 is also moved upwardly or downwardly together with the ball bearing 17.

As the coupling member 20 is moved upwardly by the hydraulic lifter 36, the inclined ends 35 of the chucking arms 33 respectively slide on the tapered ends 24 of the vertical arms 23 so as to close a distance between the vertical ends 34 of the chucking arms 33. As a result, the auger shaft 2 is tightly chucked between the chucking arms 33. When the rotary cylinder 31 is rotated by the driving device, the rotation of the rotary cylinder 31 is transmitted to the auger shaft 2 through the chucking arms 33. Though the rotation of the rotary cylinder 31 is also transmitted to the coupling member 20 through the chucking arm 33, the coupling member 20 can rotate together with the auger shaft 2 with the help of the ball bearing 27, as described above. Therefore, the auger shaft 2 can be advanced to or withdrawn from the earthen foundation while rotating the auger shaft 2 by moving the movable housing 4 downwardly or upwardly.

Figure 4:
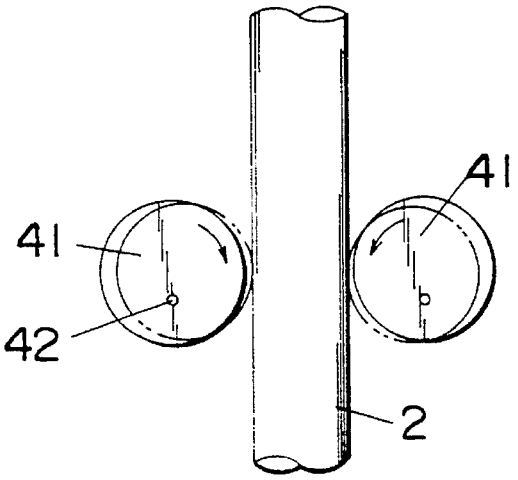
FIG. 4 explains a chucking method of an auxiliary chucking device of the auger shaft.

On the contrary, when the coupling member 20 is moved downwardly by the hydraulic lifter 36, the chucking of the auger shaft 2 with the vertical ends 34 of the chucking arms 33 is released. Therefore, since the rotation of the rotary cylinder 31 is not transmitted to the auger shaft 2, it is possible to move the movable housing 4 upwardly or downwardly without transferring the auger shaft 2. In particular, it is preferred that the auger shaft 2 is chucked with the auxiliary chucking device 40 for stably supporting the auger shaft 2 when the chucking of the auger shaft 2 with the main chucking device 30 is released. For example, the auxiliary chucking device 40 is formed with a pair of chucking members 41 each of which has an eccentric axis 42. When each of the chucking members 41 is rotated about the eccentric axis 42, as indicated by the arrows of FIG. 4, so as to close a distance between the chucking members 41, the auger shaft 2 is hold by the chucking members 41.

Figure 5:
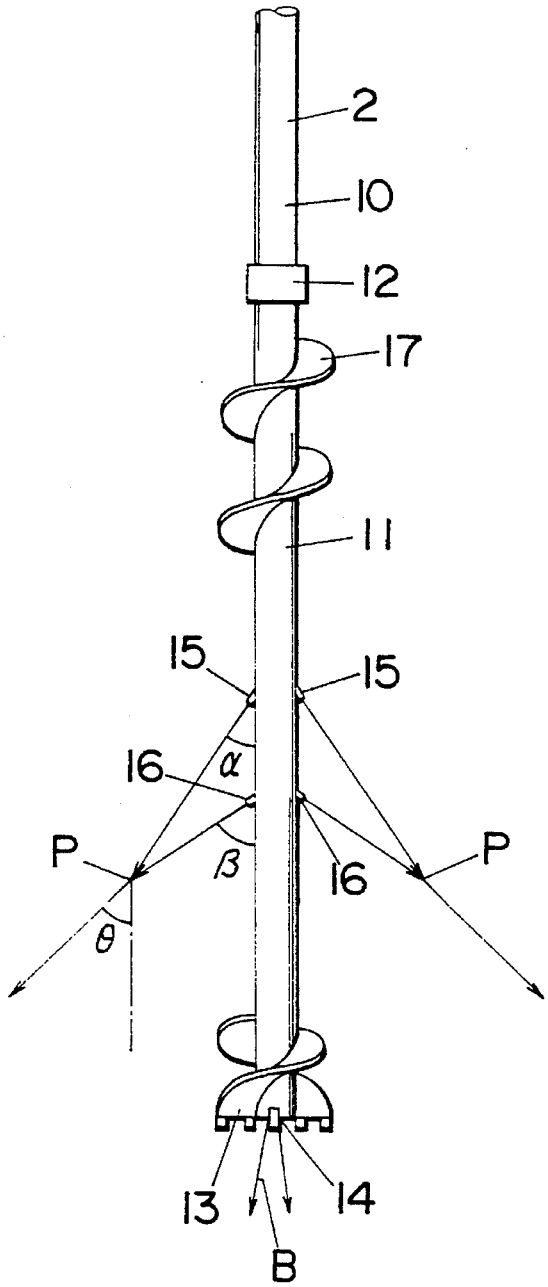
FIG. 5 is a front view of an auger shaft of the present invention.

As shown in FIG. 5, the auger shaft 2 is composed of an lower rod 11 having excavating components, an upper rod 10 for reaching the lower rod 11 to a predetermined depth in the earthen foundation, and a joint 12 connecting between the upper rod 10 and lower rod 11. The lower rod 11 is formed with a bit 13, a bottom nozzle 14 for jetting a fluid, two pairs of upper and lower nozzles (15 and 16) for jetting a consolidating fluid, and a spiral screw 17. The fluid is jetted downwardly from the bottom nozzle 14, as shown by the arrows "B" of FIG. 5, in order to facilitate the progress of the auger shaft 2 into the earthen foundation. For example, a diluted cement milk or a mixture solution of cement milk and bentonite, or the like, is used as the fluid. On the other hand, a cement milk, or a mixture solution the main ingredient of which is the cement milk or a synthetic resin solution, or the like, is used as the consolidating fluid. The consolidating fluid is jetted in a first direction from the upper nozzle 15. The first direction is a downwardly diagonal direction which is defined by an acute angle $\alpha$ between the axis of the auger shaft 2 and the first direction, as shown in FIG. 5. The consolidating fluid is also jetted in a second direction from the lower nozzle 16. The second direction is a downwardly diagonal direction which is defined by an acute angle $\beta$ between the axis of the auger shaft 2 and the second direction, as shown in FIG. 5. Since the angle $\alpha$ is smaller than the angle $\beta$, the consolidating fluid jetted from the upper nozzle 15 collides with that jetted from the lower nozzle 16 at a collision point P to thereby generate a joined jet of the consolidated fluid in a third direction. In this time, though a small amount of the consolidating fluid is scattered at the collision point P, most of the consolidating fluid advances as the joined jet in the third direction. The third direction is a downwardly diagonal direction which is defined by an acute angle $\theta$ between the axis of the auger shaft 2 and the third direction, as shown in FIG. 5. The third direction can be varied by controlling an injection pressure of the consolidating fluid from the upper nozzle 15 or the lower nozzle 16. For example, as the injection pressure of the consolidating fluid from the upper nozzle 15 is larger, the angle $\theta$ approaches the angle $\alpha$. An available range of the angle $\theta$ is expressed by $\alpha<\theta<\beta$.

Figure 6:
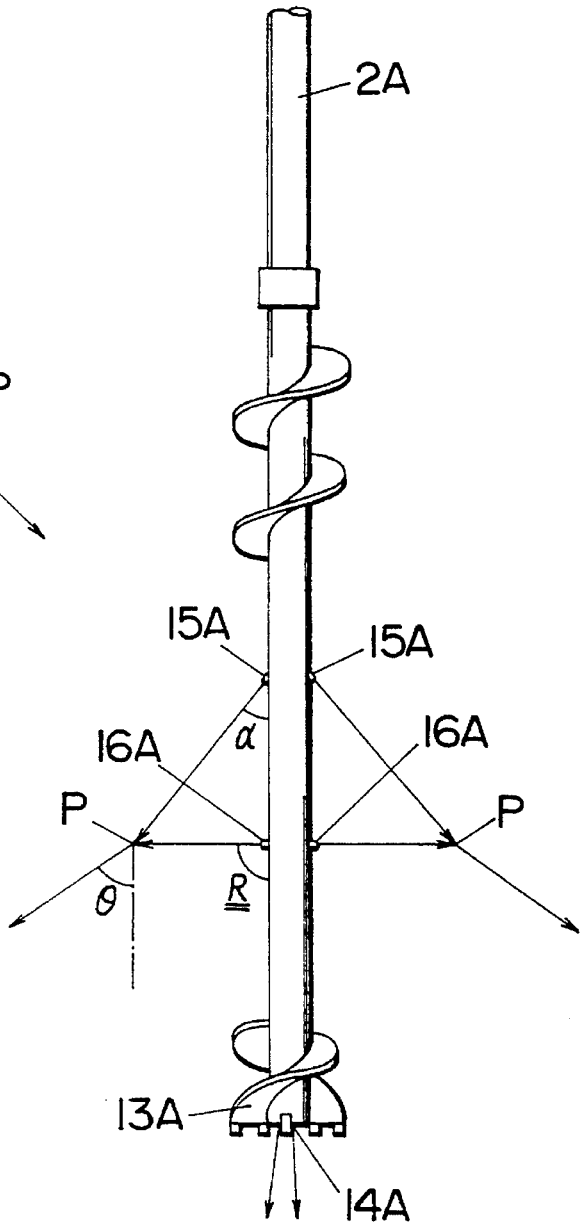
FIG. 6 is a front view of another auger shaft of the present invention.

It is possible to use an auger shaft 2A of FIG. 6 in place of the above auger shaft 2. The consolidating fluid is jetted from a lower nozzle 16A of the auger shaft 2A in a substantially horizontal direction which is defined by a right angle R to the axis of the auger shaft 2A. Therefore, the consolidating fluid jetted from an upper nozzle 15A collides with that jetted from the lower nozzle 16A at a point on the horizontal direction. After the collision, a joined jet of the consolidating fluid advances in a downwardly diagonal direction.

Figure 7:
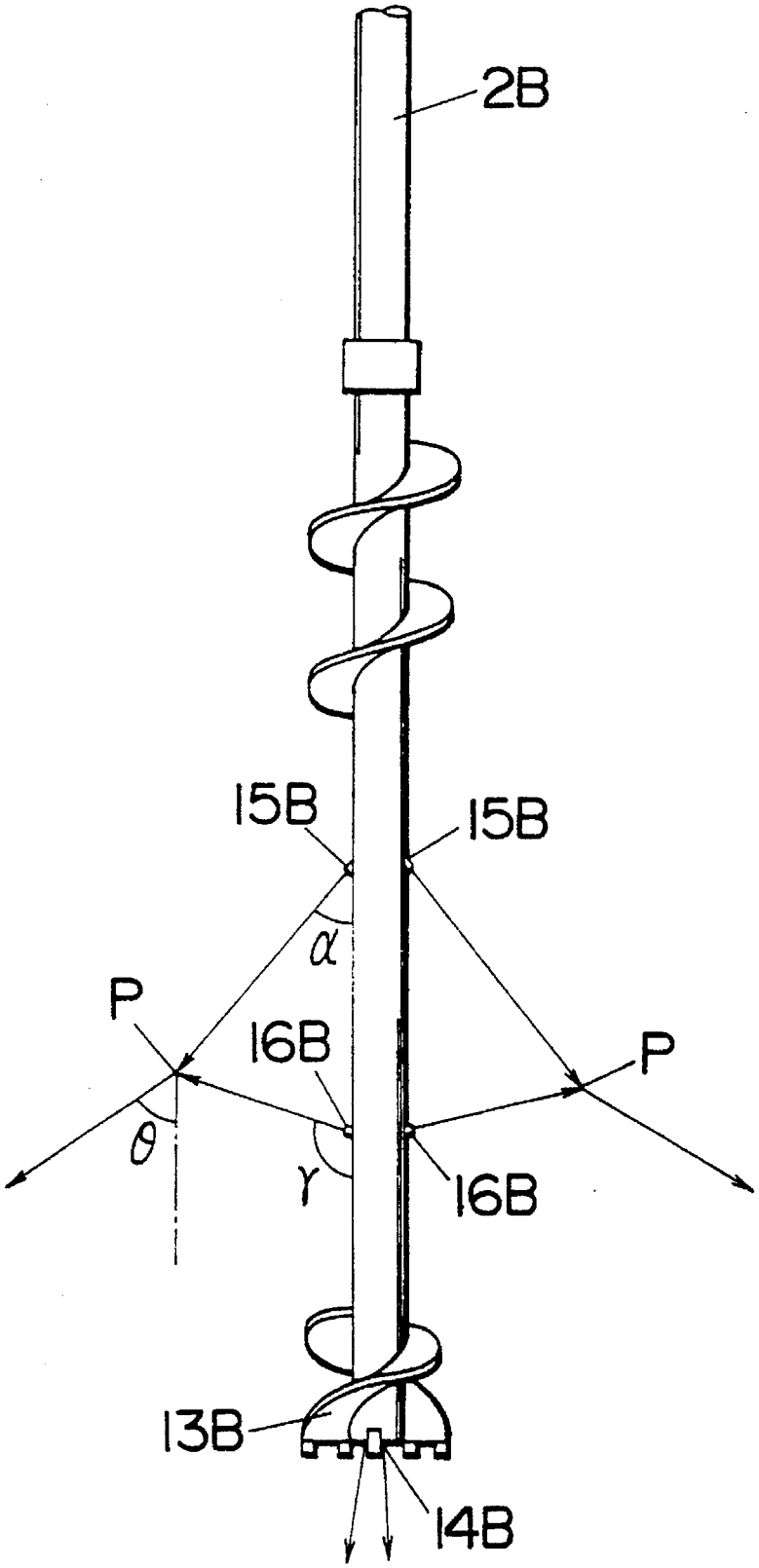
FIG. 7 is a front view of still another auger shaft of the present invention.

In addition, it is possible to use an auger shaft 2B of FIG. 7 in place of the auger shaft 2. The consolidating fluid is jetted from a lower nozzle 16B of the auger shaft 2B in an upwardly diagonal direction as the second direction which is defined by an obtuse angle $\gamma$, between the axis of the auger shaft 2B and the second direction. In this case, it is required that the injection pressure of the consolidating fluid from an upper nozzle 15B is larger than that jetted from the lower nozzle 16B in order to advance a joined jet in a downwardly diagonal direction. For varying the injection pressure, it is preferred that the consolidating fluid is supplied separately to the upper and lower nozzles (15B and 16B) through feed lines (not shown) arranged in the auger shaft 2B.

Figures 8A, 8B, 8C, 8D, 8E:
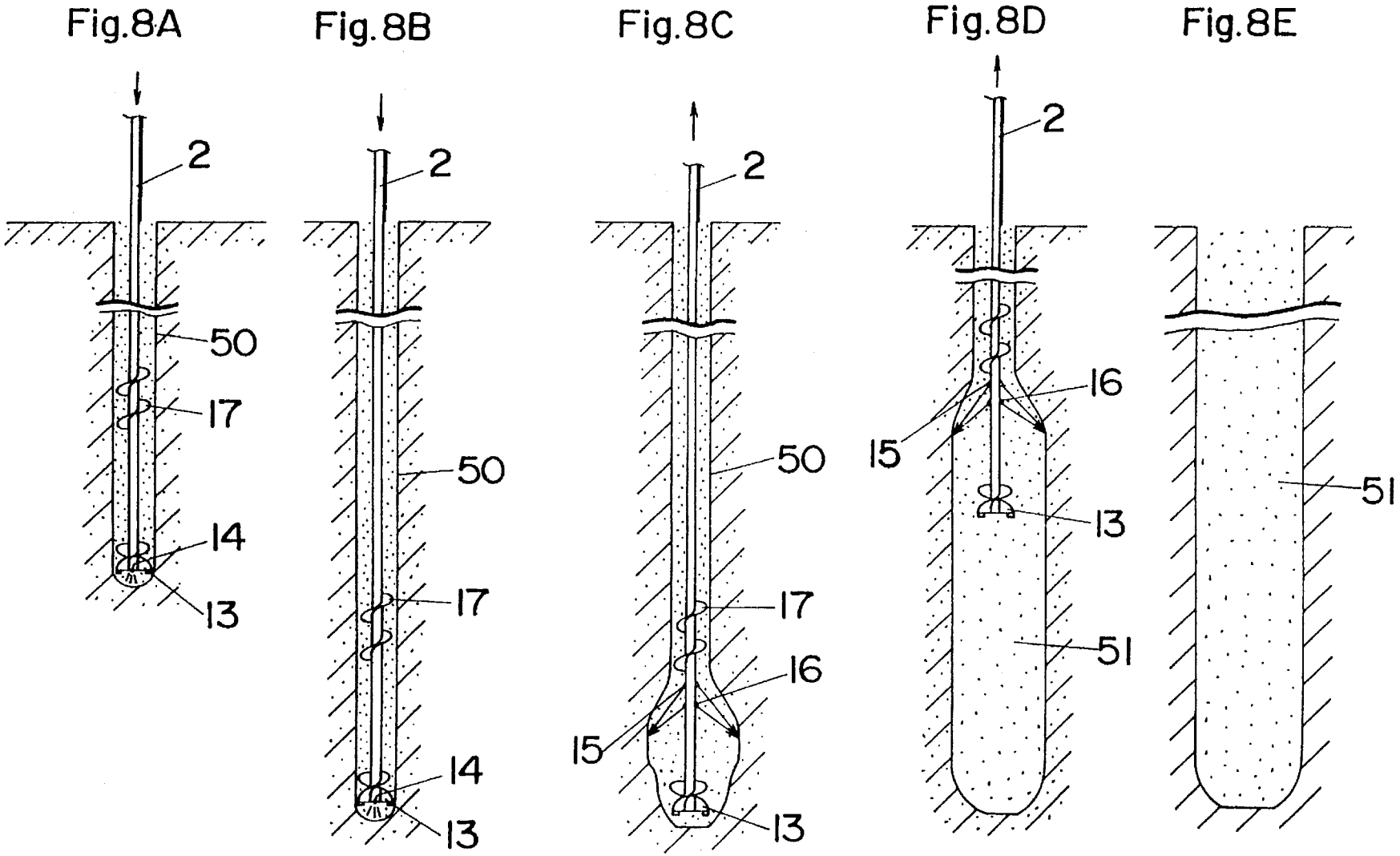
FIGS. 8A to 8E show a process of forming a modified ground pillar in an earthen foundation with the use of the auger shaft of FIG. 5.

By the use of the above explained excavator 1, a modified ground pillar 51 can be formed in an earthen foundation in accordance with the following method of the present invention. That is, the present method comprises an excavating step, as shown in FIGS. 8A and 8B, and a withdrawing step of the auger shaft 2, as shown in FIGS. 8C to 8E. In the excavating step, the earthen foundation is excavated with the bit 13 to form therein a hole 50 by rotating the auger shaft 2 while jetting the fluid from the bottom nozzle 14 and without jetting the consolidating fluid from the upper and lower nozzles (15 and 16) until the hole 50 having a predetermined depth is formed, as shown in FIG. 8B. The spiral screw 17 is useful to keep the excavated soil softly in the hole 50 during the excavating step. In addition, since a part of the excavated soil is exhausted to the outside of the hole 50 by the spiral screw 17, it is possible to prevent an overflow of a considerable amount of the fluid from the hole 50.

In the withdrawing step, the auger shaft 2 is withdrawn away from the bottom of the hole 50 without jetting the fluid from the bottom nozzle 14 and while rotating the auger shaft 2 and jetting the consolidating fluid in downwardly diagonal directions from the upper and lower nozzles (15 and 16) against soil surrounding the hole 50 to break the same for enlarging the diameter of the hole 50 in such a manner as to perform an in-situ stirring and mixing of the consolidating fluid and the soil, so that the modified ground pillar 51 having a larger diameter than the hole 50 is formed in the earthen foundation, as shown in FIG. 8E. In the withdrawing step, since a joined jet of the consolidating fluid is always directed in a diagonally downward direction, it is possible to continue the withdrawing step precisely and safely even at the periphery of the entrance of the excavated hole 50 without causing upheavals of the ground or blowing the soil to the outside of the excavated hole by the joined jet. The diameter of the modified ground pillar 51 is substantially equal to that of a collision trace of the consolidating fluid. The diameter of the modified ground pillar 51 can be varied by controlling an injection pressure of the consolidating fluid in response to a geological character of a planned site of the modified ground pillar 51.

Figure 9:
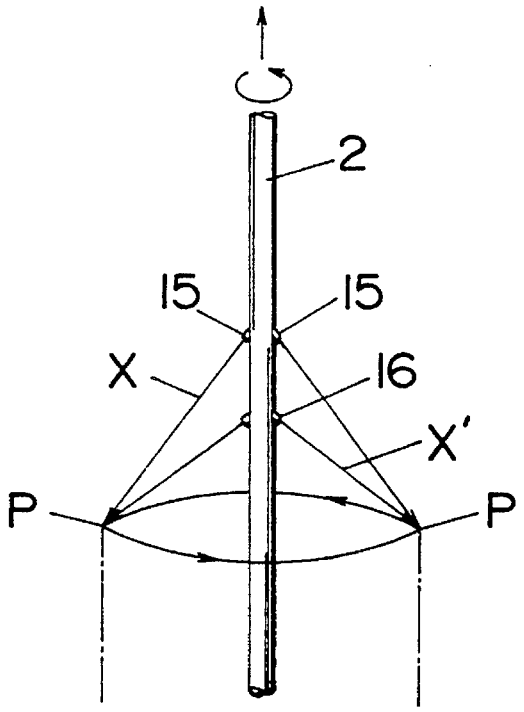
FIG. 9 is a perspective view showing a stirring and mixing range obtained when the auger shaft of FIG. 5 is rotated while jetting a consolidating fluid therefrom.

When the auger shaft 2 is rotated while jetting the consolidating fluid in downwardly diagonal directions from the upper and lower nozzles 15 and 16, traces of the consolidating fluid are provided with curved surfaces of first and second conical shapes (X and X'), respectively, as shown in FIG. 9. A base of the first conical shape X is the same as that of the second conical shape X'. A radius of the base is equal to a distance between collision point "P" of the consolidating fluid and the axis of the auger shaft 2. An outline of the base designates a collision trace of the consolidating fluid.

Figure 10:
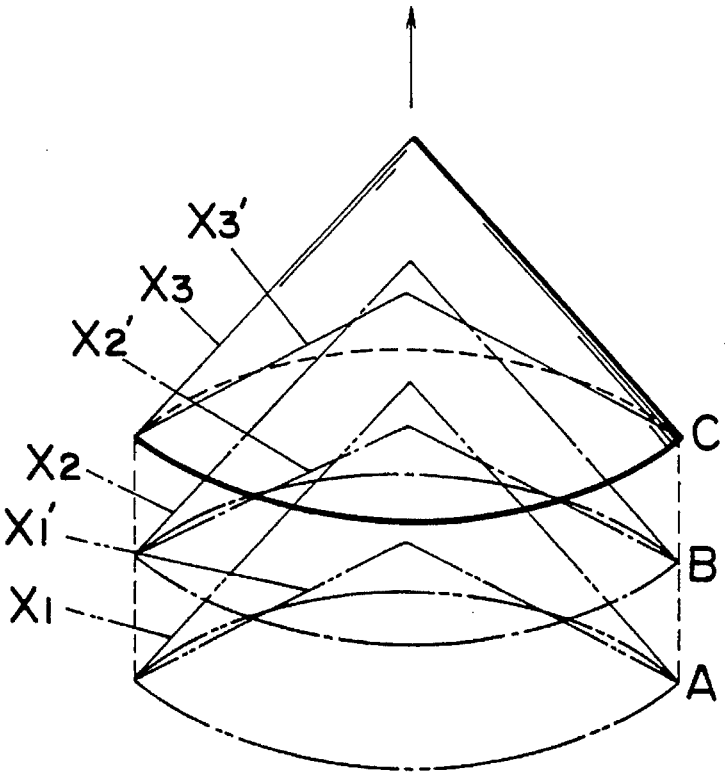
FIG. 10 is a diagram illustrating stirring and mixing ranges obtained when the auger shaft of FIG. 5 is withdrawn while rotating the auger shaft and jetting the consolidating fluid.

For example, as shown in FIG. 10, as the auger shaft 2 is withdrawn from the position "A" to the position "C", while rotating the auger shaft 2 and jetting the consolidating fluid in downwardly diagonal directions, a first three-dimensional (approximately conically shaped) stirring and mixing range shifts from X1 to X3, and at the same time a second three-dimensional (approximately conically shaped) stirring and mixing range shifts from X'1 to X'3. In addition, the first stirring and mixing range of the consolidating fluid jetted from the upper nozzle 15 is three-dimensionally overlapped with the second stirring and mixing range of the consolidating fluid jetted from the lower nozzle 15.

Figure 11:
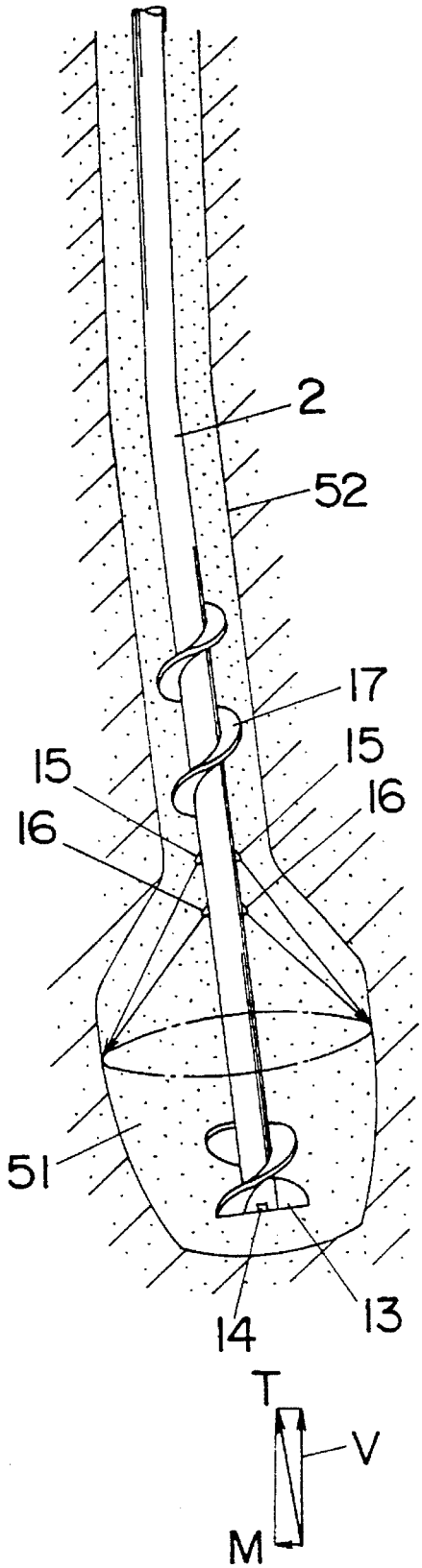
FIG. 11 is a diagram illustrating a self-recovery force occurring when the auger shaft of FIG. 5 in an inclined hole is withdrawn according to the present method.

By the way, in case of inserting the auger shaft 2 into an earthen foundation, there causes a problem that the auger shaft 2 is often inserted in an inclined direction due to a contacting pressure between the bit 13 and the earthen foundation during the excavating step, so that an inclined hole 52 is formed in the earthen foundation. However, even when such an inclined hole 52 is formed by the excavating step, as shown in FIG. 11, a modified ground pillar having an improved vertical accuracy can be formed by the withdrawing step of the present invention. That is, the auger shaft 2 is withdrawn away from the inclined hole 52 with a withdrawing force indicated by the arrow "T" of FIG. 11, while rotating the auger shaft 2 and jetting the consolidating fluid. Since the contacting pressure is released and the soil surrounding the inclined hole 52 is softened by the consolidating fluid jetted from the upper and lower nozzles (15 and 16 ), a self-recovery force of the auger shaft 2 effectively works in a direction indicated by the arrow "M" of FIG. 11. As a result, the auger shaft 2 elastically deformed in the inclined hole 52 can recovers its original shape as soon as the withdrawing step starts. Subsequently, since the withdrawing step is continued while keeping the original shape of the auger shaft 2, the modified ground pillar can be formed perpendicularly in the earthen foundation irrespective of the inclined hole. The arrow "V" of FIG. 11 designates a vertical component of the withdrawing force "T".

Figures 13A, 13B, 13C, 13D:
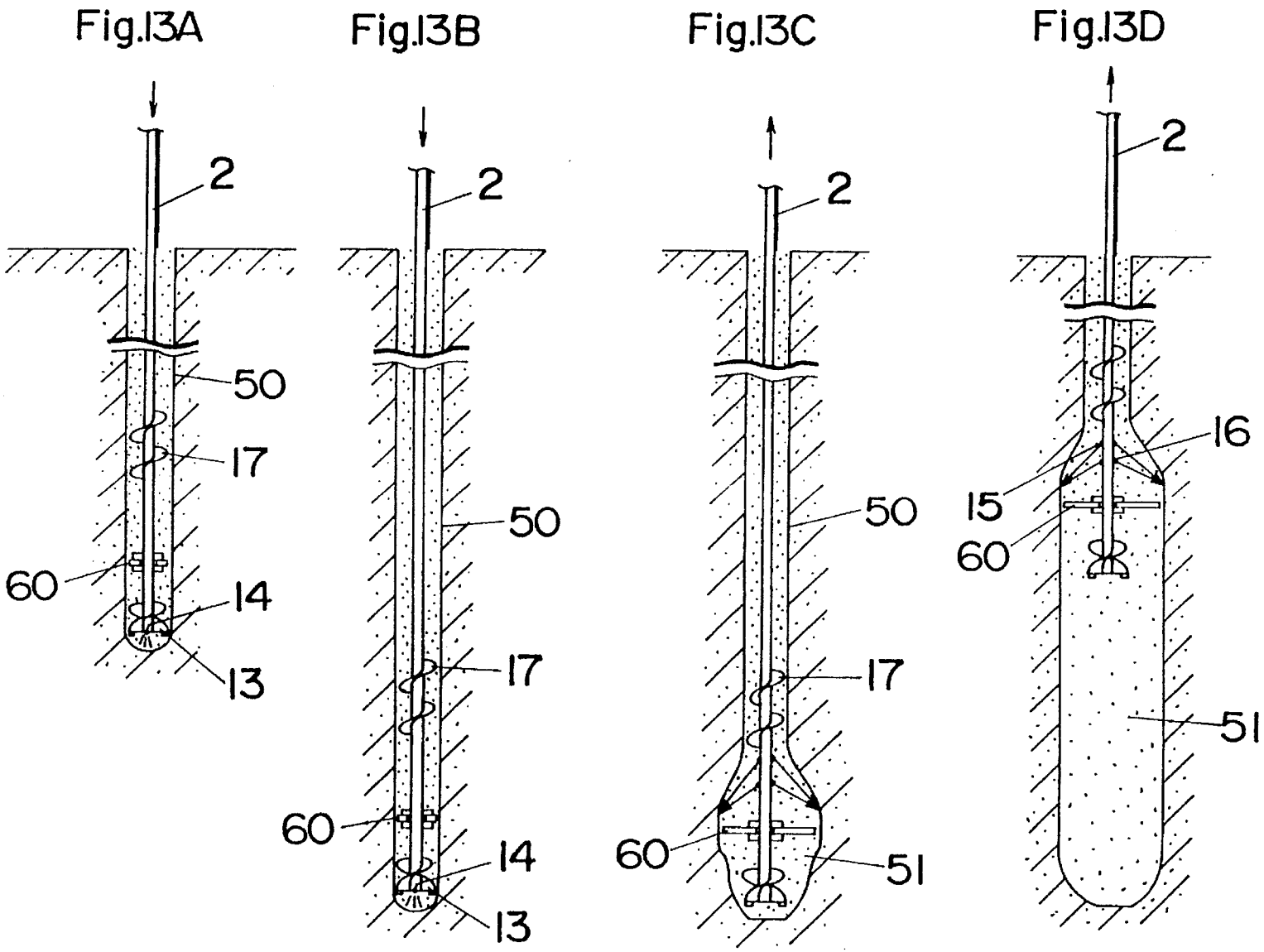

For more efficiently constructing the modified ground pillar 51, it is preferred that the auger shaft 2 further includes a folding stirrer 60, as shown in FIG. 12. The folding stirrer 60 is capable of selectively taking an expanded form or a reduced form to vary an outside diameter thereof about the axis of the auger shaft 2. In the present method, the folding stirrer 60 is kept in the reduced form during the excavating step, as shown in FIGS. 13A and 13B, and in the expanded form to facilitate the stirring and mixing of the excavated soil with the consolidating fluid jetted from the upper and lower nozzles (15 and 16) during the withdrawing step, as shown in FIGS. 13C and 13D. In the auger shaft 2 of FIG. 12, though the consolidating fluid is jetted from the upper and lower nozzles (15 and 16)in downwardly diagonal directions, it is possible to jet the consolidating fluid from the upper nozzle 15 in a downwardly diagonal direction and from the lower nozzle 16 in a substantially horizontal direction or an upwardly diagonal direction, as described above.

As shown in FIGS. 14 and 15, the folding stirrer 60 is formed with a pair of stirring wings 61, top and bottom flanges (62 and 63) each of which is in a substantially rectangular shape, and a barrel portion 64 having a shape like a rhombic prism which is disposed between the top and bottom flanges (62 and 63). A pair of pins 65 extends from opposed corners of the top flange 62 to the corresponding corners of the bottom flange 63. Pivot ends 66 of the stirring wings 61 are respectively engaged with the pins 65 such that each of the stirring wings 61 can pivot about the pin 65 to make the expanded form or reduced form of the folding stirrer 60. It is preferred that a free end of the stirring wing 61 is provided with a cutting head 67 for enhancing the withdrawing step. When the folding stirrer 60 in the reduced form is rotated clockwise about the axis of the auger shaft 2, as indicated by the arrow "R" of FIG. 14, the stirring wings 61 respectively pivot counterclockwise about the pins 65 to make the expanded form of the folding stirrer 60, as shown in FIG. 15. On the contrary, when the folding stirrer 60 in the expanded form is rotated counterclockwise about the axis of the auger shaft 2, as indicated by the arrow "L" of FIG. 15, the stirring wings 60 respectively pivot clockwise about the pins 65 to make the reduced form thereof, as shown in FIG. 14.

It is further preferred that the auger shaft 2 has a folding stirrer 60A in place of the above folding stirrer 60, as shown in FIGS. 16 to 18. The folding stirrer 60A comprises a pair of folding units, and top and bottom discs (62A and 63A) each of which has a center through-hole for the auger shaft 2. Each of the folding unit comprises a stirring rod 61A having a joint portion 64A at one end thereof, an oil pressure device 65A, a first pin 66A for allowing the oil pressure device 65A to pivot about the first pin 66A, and a second pin 67A for allowing the stirring rod 61A to pivot about the second pin 67A. The first and second pins (66A and 67A) of one folding unit are respectively positioned in a central-symmetrical relation about the axis of the auger shaft 2 with those pins of the other folding unit. An extendible cylinder 68A of the oil pressure device 65A is jointed with the joint portion 64A of the stirring rod 61A such that when the extendible cylinder 68A is reduced by the oil pressure device 65A, the stirring rod 61A can pivot counterclockwise about the second pin 67A, as indicated by the arrow L' of FIG. 18, to obtain an expanded form of the folding stirrer 60A of FIG. 16, and on the contrary, when the extendible cylinder 68A is expanded by the oil pressure device 65A, the stirring rod 61A can pivot clockwise about the second pin 67A, as indicated by the arrow R' of FIG. 18, to obtain a reduced form of the folding stirrer 60A of FIG. 17. In FIG. 18, a dotted line of the stirring rod 61A designates the reduced form of the folding stirrer 60A, and a solid line thereof designates the expanded form of the folding stirrer 60A.

It is still further preferred that the auger shaft 2 has a folding stirrer 60B in place of the above folding stirrer 60, as shown in FIGS. 19 and 20. Stirring rods 61B of the folding stirrer 60B can be expanded or reduced in accordance with the substantially same manner as the stirring rods 61A of the folding stirrer 60A except that the stirring rods 61B are moved along a vertical plane including the axis of the auger shaft 2, as shown in FIG. 20. In FIG. 20, a dotted line of the stirring rod 61B designates a reduced form of the folding stirrer 60B, and a solid line thereof designates an expanded form of the folding stirrer 60B.

In the present invention, any one of the above explained stirrers (60, 60A and 60B) can be provided on the auger shaft 2 downwardly of the lower nozzle 16. A diameter "D" of a collision trace of the consolidating fluid jetted from the upper and lower nozzles (15 and 16) is determined so as to be slightly larger than a total length "L1" of the folding stirrer in the expanded form, as shown in FIG. 21.

By the way, in case of breaking the soil surrounding an excavated hole mainly with the use of the fording stirrer, there is a problem of accidentally causing a breakage of the folding stirrer. However, in the present method, since the soil surrounding the excavated hole is broken substantially by the consolidating fluid jetted from the upper and lower nozzles, it is possible to efficiently perform the withdrawing step without causing such a breakage of the folding stirrer.

<Second Embodiment>

For efficiently constructing a modified ground wall in an earthen foundation, it is preferred to use an excavator 1C having a plurality of auger shafts 2C, as shown in FIG. 22. Each of the auger shafts 2C is formed with a bit 13C, a bottom nozzle 14C for jetting a fluid, two pairs of upper and lower nozzles (15C and 16C) for jetting a consolidating fluid, and a spiral screw 17C. The auger shafts 2C pass through tie-beam members 70C which can be inserted into the earthen foundation together with the auger shaft 2C. The tie-beam member 70C is useful for maintaining a distance between adjacent auger shafts 2C. Of course, the auger shafts 2C are rotatably supported by bearing portions 72C of the tie-beam member 70C. The tie-beam member 70C further includes a plurality of auxiliary nozzles 71C for jetting the fluid downwardly to facilitate the progress of the tie-beam member 70C into the earthen foundation. Numeral 73C designates a hose tube for supplying the fluid to the auxiliary nozzle 71C. Radiuses of gyrations of the bit 13C and the spiral screw 17C of the auger shaft 2C are determined such that a hole excavated by each of the auger shafts 2C is not overlapped with that excavated by an adjacent auger shaft 2C, as indicated by the range "S" of FIG. 26B. The upper and lower nozzles (15C and 16C) of each of the auger shafts 2C are axially staggered with the nozzles of the adjacent auger shaft 2, as shown in FIG. 23, so as to prevent collision of the consolidating fluid between the adjacent auger shafts 2C. The arrows drawn in FIG. 23 designate jetting directions of the consolidating fluid and the fluid.

In place of the auger shafts 2C, it is possible to use another auger shafts 2D, as shown in FIG. 24. Upper and lower nozzles (15D and 16D) of each of the auger shafts 2D are angularly disposed with respect to the nozzles of an adjacent auger shaft 2D so as to prevent collision of the consolidating fluid between the adjacent auger shafts. In FIG. 24, positions of the upper and lower nozzles (15D and 16D) of the auger shaft 2D is shifted at a right angle to those of the adjacent auger shaft 2D.

In addition, it is possible to use still another auger shafts 2E, as shown in FIG. 25. Positions of upper and lower nozzles (15E and 16E) of the auger shafts 2E are determined so as to cause collision of the consolidating fluid between adjacent auger shafts 2E.

In the above explained auger shafts (2C, 2D and 2E), the consolidating fluid is jetted from the upper and lower nozzles in downwardly diagonal directions to generate a joined jet of the consolidating fluid in a downwardly diagonal direction. As described in the first embodiment, it is possible to jet the consolidating fluid from the upper nozzle in the downwardly diagonal direction and from the lower nozzle in a substantially horizontal direction or an upwardly diagonal direction to generate the joined jet.

Figures 26A, 26B, 26C, 26D, 26E:
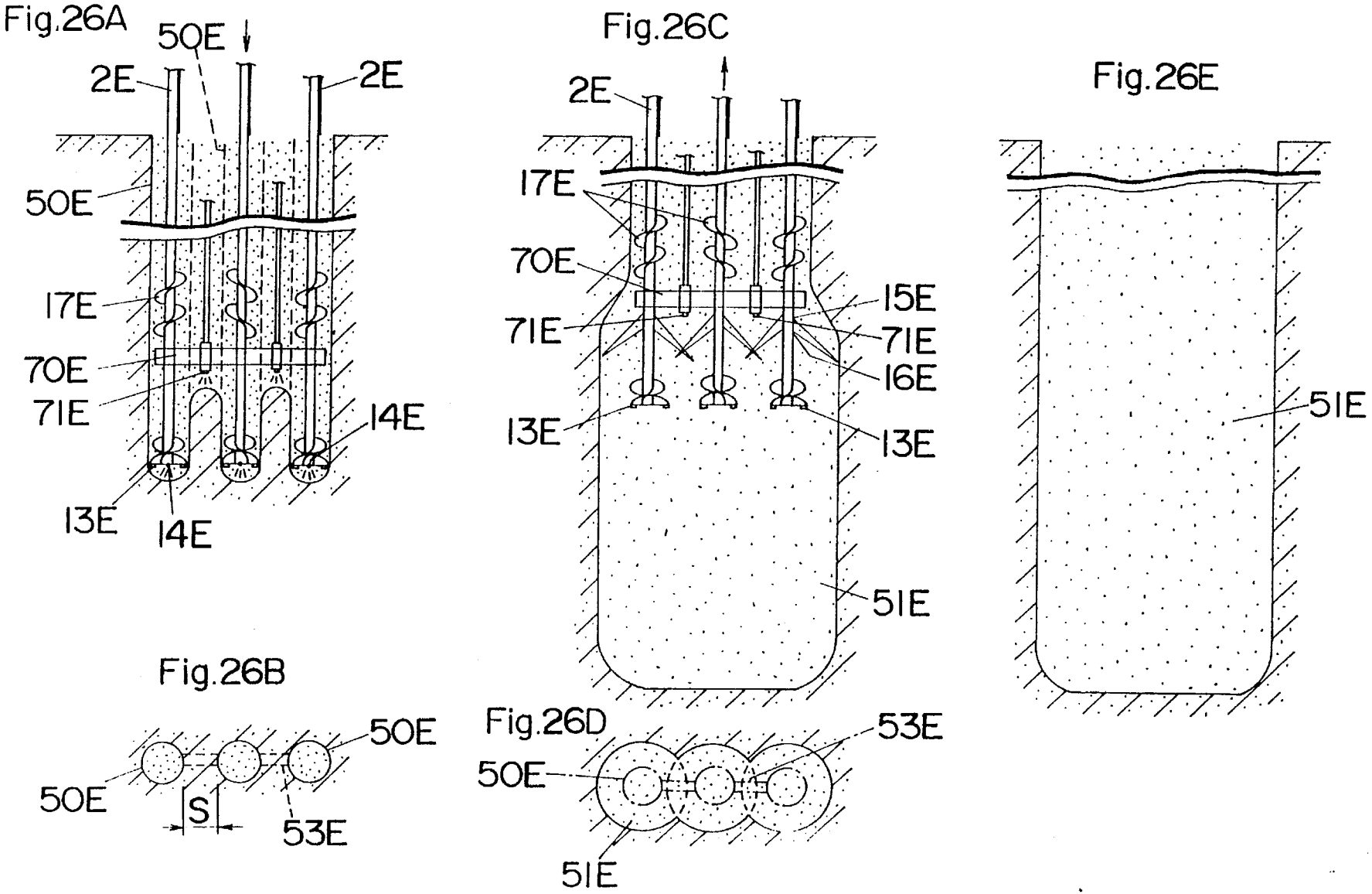

For example, by the use of the auger shaft 2E, a modified ground wall 51E can be formed in an earthen foundation in accordance with the following method of the present invention. That is, the method comprises an excavating step, as shown in FIGS. 26A and 26B, and a withdrawing step of the auger shafts 2E, as shown in FIGS. 26C to 26E. In the excavating step, the earthen foundation is excavated with bits 13E of the auger shafts 2E to form therein holes 50E by rotating the auger shafts 2E while jetting the fluid from bottom nozzles 14E and auxiliary nozzles 71E without jetting the consolidating fluid from the upper and lower nozzles (15E and 16E) until the holes 50E having a predetermined depth are formed. Each of the holes 50E is not overlapped with an adjacent hole and is connected with the adjacent hole only by a rectangular hole 53E which is excavated by the fluid jetted from the auxiliary nozzle 71E, as shown in FIG. 26B. Subsequently, in the withdrawing step, the auger shafts 2E are withdrawn away from the holes 50E without jetting the fluid from the bottom nozzles 14E and the auxiliary nozzles 71E while rotating the auger shafts 2E and jetting the consolidating fluid from the upper and lower nozzles (15E and 16E) in downwardly diagonal directions against soil surrounding the holes 50E for enlarging the diameter of the hole such that each of modified ground pillars is partially overlapped with an adjacent modified ground pillar to form the modified ground wall 51E, as shown in FIGS. 26C and 26D. Thus formed wall 51E is utilized as an underground water cut-off wall, landslide protection wall, or a foundation pile in the earthen foundation. As shown in FIG. 26E, in this embodiment, since a joined jet of the consolidating fluid jetted from the upper and lower nozzles (15E and 16E) is always advanced in a downwardly diagonal direction during the withdrawing step, it is possible to continue the withdrawing step precisely and safely even at the periphery of the entrance of the hole 50E without causing upheavals of the ground and blowing the soil to the outside of the hole 50E by the joined jet.

For example, in case of using the excavator 1E, a stirring and mixing range obtained during the withdrawing step is explained below. As shown in FIG. 27, when the three auger shafts 2E of FIG. 25 are rotated while jetting the consolidating fluid in the downward diagonal directions from the upper and lower nozzles (15E and 16E), traces of the consolidating fluid are provided with curved surfaces of first conical shapes (X, Y and Z) and second conical shapes (X', Y' and Z'), as shown in FIG. 27, and are partially overlapped between adjacent auger shafts 2E. In FIG. 27, each of the auger shafts 2E is rotated in the opposite direction to the adjacent auger shaft. As the auger shafts 2E are withdrawn from the position "A" to the position "C" upwardly while rotating the auger shafts 2E and jetting the consolidating fluid, the first and second conical shapes providing three-dimensional stirring and mixing ranges shift from X1 to X3, X'1 to X'3, Y1 to Y3, Y'1 to Y'3, Z1 to Z3 and Z'1 to Z'3, respectively, as shown in FIG. 28. The first stirring and mixing range is three-dimensionally overlapped with the second stirring and mixing range. In addition, the first and second stirring and mixing ranges of each of the auger shafts 2E are partially overlapped with those of the adjacent auger shaft. As a result, it is possible to perform an efficient stirring and mixing of the excavated soil with the consolidating fluid during the withdrawing step.

Figure 30A:
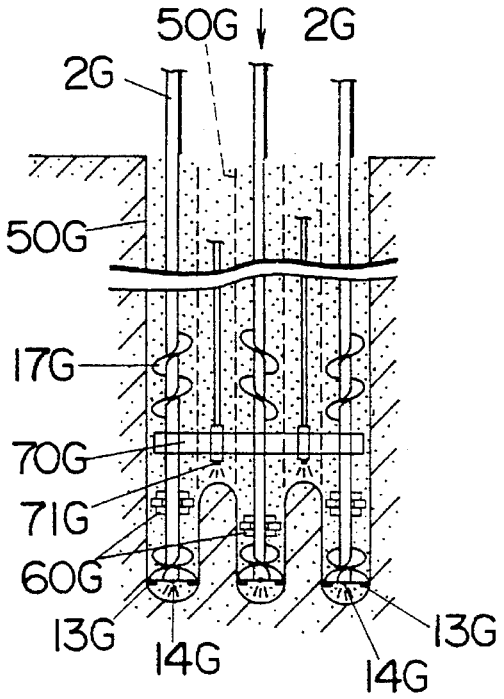
Figure 30B:
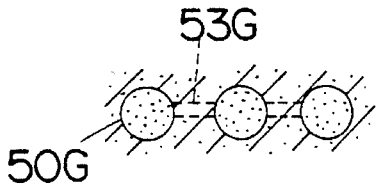
Figure 30C:
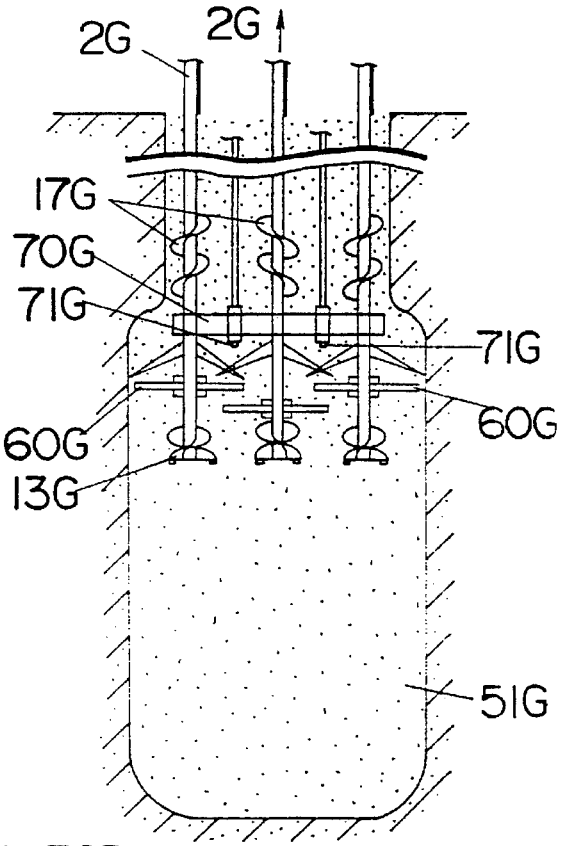
Figure 30D:
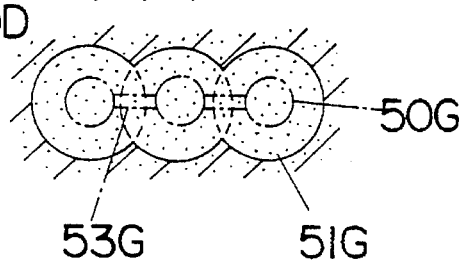

It is also preferred that auger shafts 2G having folding stirrers 60G are used in place of the auger shafts 2C, as shown in FIG. 29. It is possible to use any one of the above explained folding stirrers (60, 60A and 60B) as the folding stirrer 60G. When the auger shafts 2G are utilized to form a modified ground wall 51G in an earthen foundation, each of the folding stirrers 60G is kept in a reduced form thereof during the excavating step, as shown in FIG. 30A, and in an expanded form thereof to facilitate a stirring and mixing of the excavated soil and the consolidating fluid during the withdrawing step, as shown in FIG. 30C. In the excavating step, a radius of gyration of the folding stirrer 60G is not overlapped with that of an adjacent folding stirrer, as shown in FIG. 30B. On the other hand, in the withdrawing step, the radius of gyration of the folding stirrer 60G is partially overlapped with that of the adjacent folding stirrer to form a modified ground wall 51G, as shown in FIG. 30D. In this case, the auger shafts 2G are rotated so as not to cause collision of stirring wings or rods between the adjacent folding stirrers 60G. The arrows drawn in FIG. 29 designate jetting directions of the consolidating fluid and the fluid.

In the excavator 1G of FIG. 29, upper and lower nozzles (15G and 16G) of the auger shafts 2G are disposed so as to cause collision of the consolidating fluid between adjacent auger shafts 2G. However, it is possible to provide the folding stirrer (60, 60A or 60B) on the auger shaft (2C or 2D) of FIG. 23 or 24.

In the auger shafts (2C, 2D or 2G), the consolidating fluid is jetted from the upper and lower nozzles in downwardly diagonal directions. However, it is also possible to jet the consolidating fluid from the upper nozzle in a downwardly diagonal direction and from the lower nozzle in a substantially horizontal direction or an upwardly diagonal direction to generate a joined jet of the consolidating fluid.

In the above embodiments, a kind of consolidating fluid is jetted from the upper and lower nozzles. However, it is preferred that two kinds of consolidating fluids are separately jetted from the upper and lower nozzles. That is, when a first consolidating fluid jetted from one of the upper and lower nozzles collides with a second consolidating fluid jetted from the other nozzles, a consolidating reaction is caused between these consolidating fluids. For example, a water-glass is used as the first consolidating fluid, and a cement milk, a mixture of the cement milk and bentonite, a mixture of the cement milk, bentonite and a slag powder, or the like are utilized as the second consolidating fluid. In particular, it is preferred that one of the consolidating fluids, which is of a higher viscosity than the other one, is jetted from the upper nozzle.

For varying jet angles of the consolidating fluid, it is preferred that a nozzle plate having a desired nozzle is detachably attached to the auger shaft. For example, as shown in FIGS. 31 and 32, a pair of nozzle plates 90 are formed with an upper nozzle 15 and four thread holes 91. The nozzle plates 90 are attached to the auger shaft 2 with the use of bolts 92 such that the upper nozzle 15 of one of the nozzle plates 90 is circumferentially spaced away at 180 degrees from that of the other one.

For improving the strength of a modified ground pillar or wall of the present invention, it is preferred to jet a consolidating fluid including a reinforcing fiber into the earthen foundation. The fiber is selected from a steel fiber, a synthetic resin, and a mixture thereof. For example, length and diameter of the reinforcing fiber are selected from the ranges of 3 to 6 cm, and 0.3 to 1.5 mm, respectively.

What is claimed is:

1. A method of forming a modified ground in an earthen foundation with the use of an excavator having at least one rotary shaft, said method comprising the steps of:

inserting said rotary shaft into the earthen foundation to form therein a hole by rotating said rotary shaft until said hole is excavated to reach a predetermined depth;

withdrawing said rotary shaft away from the bottom of said hole while rotating said rotary shaft and jetting a consolidating fluid from at least one pair of upper and lower nozzles of said rotary shaft against soil surrounding said hole to break the same for enlarging the diameter of said hole in such a manner as to perform an in-situ mixing and stirring of said consolidating fluid and soil, whereby forming said modified ground having a larger diameter than said hole; and wherein said upper and lower nozzles are provided in said rotary shaft such that said consolidating fluid jetted from said upper nozzle in a downwardly diagonal direction collides with that jetted from said lower nozzle to generate a joined jet of said consolidating fluid in a downwardly diagonal direction.

2. A method as set forth in claim 1, wherein said consolidating fluid is jetted from said lower nozzle in a downwardly diagonal direction.

3. A method as set forth in claim 1, wherein said consolidating fluid is jetted from said lower nozzle in a substantially horizontal direction.

4. A method as set forth in claim 1, wherein said consolidating fluid is jetted from said upper and lower nozzles with different injection pressures.

5. A method as set forth in claim 4, wherein said injection pressure of said consolidating fluid jetted from said upper nozzle is greater than that jetted from said lower nozzle.

6. A method as set forth in claim 5, wherein said consolidating fluid is jetted from said lower nozzle in an upwardly diagonal direction.

7. A method as set forth in claim 1, wherein two kinds of consolidating fluids are jetted separately from said upper and lower nozzles to cause a consolidating reaction therebetween when said consolidating fluids collide each other.

8. A method as set forth in claim 1, wherein an expandable stirrer is provided in said rotary shaft.

9. A method as set forth in claim 8, wherein said expandable stirrer is disposed downwardly of a collision point of said consolidating fluid jetted from said upper and lower nozzles.

10. A method as set forth in claim 8, wherein said expandable stirrer being capable of selectively taking an expanded form and a reduced form to vary an outside diameter of said expandable stirrer about the axis of said rotary shaft.

11. A method as set forth in claim 10, wherein said expandable stirrer is kept in said reduced form during said inserting step, and in said expanded form during said withdrawing step.

12. A method as set forth in claim 1, wherein said upper and lower nozzles are respectively provided in nozzle plates which are detachably attached to said rotary shaft.

13. A method as set forth in claim 1, wherein said excavator has a plurality of said rotary shafts.

14. A method as set forth in claim 13, wherein said withdrawing step is performed so as to cause a collision of said consolidating fluid jetted from each of said rotary shafts with that jetted from an adjacent rotary shaft.

15. A method as set forth in claim 13, wherein said withdrawing step is performed without causing a collision of said consolidating fluid jetted from each of said rotary shafts with that jetted from an adjacent rotary shaft.

16. An excavator having at least one rotary shaft used for a method of forming a modified ground in an earthen foundation, said method comprising the steps of:

inserting said rotary shaft into the earthen foundation to form therein a hole by rotating said rotary shaft until said hole is excavated to reach a predetermined depth;

withdrawing said rotary shaft away from the bottom of said hole while rotating said rotary shaft and jetting a consolidating fluid from said rotary shaft against soil surrounding said hole to break the same for enlarging the diameter of said hole in such a manner as to perform an in-situ mixing and stirring of said consolidating fluid and soil, whereby forming said modified ground having a larger diameter than said hole; and wherein said rotary shaft includes:

means for excavating the earthen foundation to enhance said inserting step; and at least one pair of upper and lower nozzles for jetting said consolidating fluid during said withdrawing step, said upper nozzle being capable of jetting said consolidating fluid in a downwardly diagonal direction so as to generate a joined jet of said consolidating fluid in a downwardly diagonal direction by collision of said consolidating fluid jetted from said upper and lower nozzles.

* * * * *